US010350905B2

(12) United States Patent
d'Armancourt

(10) Patent No.: US 10,350,905 B2
(45) **Date of Patent: *Jul. 16, 2019**

(54) DETECTING PRINTING RIBBON ORIENTATION

(71) Applicant: Datamax-O'Neil Corporation, Orlando, FL (US)

(72) Inventor: Sébastien Michel Marie Joseph d'Armancourt, Singapore (SG)

(73) Assignee: DATAMAX-O'NEIL CORPORATION, Orlando, FL (US)

( * ) Notice: Subject to any disclaimer, the term of this patent is extended or adjusted under 35 U.S.C. 154(b) by 6 days.

This patent is subject to a terminal disclaimer.

(21) Appl. No.: 15/802,714

(22) Filed: Nov. 3, 2017

(65) Prior Publication Data

US 2018/0207950 A1 Jul. 26, 2018

Related U.S. Application Data

(63) Continuation of application No. 15/416,606, filed on Jan. 26, 2017.

(51) Int. Cl.

| | |
|---|---|
| ***B41J 2/325*** | (2006.01) |
| ***B41J 31/00*** | (2006.01) |
| ***B41J 35/36*** | (2006.01) |

(52) U.S. Cl.

CPC ..... *B41J 2/325* (2013.01); *B41J 31/00* (2013.01); *B41J 35/36* (2013.01)

(58) Field of Classification Search

CPC ..... B41J 31/00; B41J 2/315; B41J 2/32; B41J 2/325; B41F 16/00; B41F 16/0006; B41F 16/0026; B41F 16/0033

See application file for complete search history.

(56) References Cited

U.S. PATENT DOCUMENTS

| | | | |
|---|---|---|---|
| 5,127,751 | A | 7/1992 | Kobayashi et al. |
| 5,684,931 | A | 11/1997 | Hagar |
| 5,813,774 | A | 9/1998 | Sone et al. |
| 6,561,643 | B1 | 5/2003 | Walker et al. |
| 6,832,725 | B2 | 12/2004 | Gardiner et al. |
| 7,128,266 | B2 | 10/2006 | Zhu et al. |
| 7,159,783 | B2 | 1/2007 | Walczyk et al. |
| 7,413,127 | B2 | 8/2008 | Ehrhart et al. |
| 7,726,575 | B2 | 6/2010 | Wang et al. |

(Continued)

FOREIGN PATENT DOCUMENTS

| | | | |
|---|---|---|---|
| WO | 01/32427 | A1 | 5/2001 |
| WO | 2013/025746 | A1 | 2/2013 |
| WO | 2013163789 | A1 | 11/2013 |

OTHER PUBLICATIONS

Extended Search Report in related European Application No. 18153104.7 dated Jun. 28, 2016, pp. 1-9 [U.S. Publication No. 2016/0325556 previously cited.].

*Primary Examiner* — Kristal Feggins

(74) *Attorney, Agent, or Firm* — Additon, Higgins & Pendieton, P.A.

(57) ABSTRACT

The present disclosure relates to devices, systems, and methods providing a ribbon sensor configured and positioned to ascertain an orientation of a printing ribbon, including devices, systems, and methods configured for detecting an improperly oriented printing ribbon, and for triggering a response in the event of an improperly installed, and/or for confirming proper installation of a printing ribbon.

20 Claims, 15 Drawing Sheets

(56) References Cited

U.S. PATENT DOCUMENTS 8,294,969 B2 10/2012 Plesko
8,317,105 B2 11/2012 Kotlarsky et al.
8,322,622 B2 12/2012 Liu
8,366,005 B2 2/2013 Kotlarsky et al.
8,371,507 B2 2/2013 Haggerty et al.
8,376,233 B2 2/2013 Van Horn et al.
8,381,979 B2 2/2013 Franz
8,390,909 B2 3/2013 Plesko
8,408,464 B2 4/2013 Zhu et al.
8,408,468 B2 4/2013 Horn et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.
8,942,480 B2 1/2015 Ellis
8,944,313 B2 2/2015 Williams et al.
8,944,327 B2 2/2015 Meier et al.
8,944,332 B2 2/2015 Harding et al.
8,950,678 B2 2/2015 Germaine et al.
D723,560 S 3/2015 Zhou et al.

(56) References Cited

U.S. PATENT DOCUMENTS 8,967,468 B2 3/2015 Gomez et al.
8,971,346 B2 3/2015 Sevier
8,976,030 B2 3/2015 Cunningham et al.
8,976,368 B2 3/2015 Akel et al.
8,978,981 B2 3/2015 Guan
8,978,983 B2 3/2015 Bremer et al.
8,978,984 B2 3/2015 Hennick et al.
8,985,456 B2 3/2015 Zhu et al.
8,985,457 B2 3/2015 Soule et al.
8,985,459 B2 3/2015 Kearney et al.
8,985,461 B2 3/2015 Gelay et al.
8,988,578 B2 3/2015 Showering
8,988,590 B2 3/2015 Gillet et al.
8,991,704 B2 3/2015 Hopper et al.
8,996,194 B2 3/2015 Davis et al.
8,996,384 B2 3/2015 Funyak et al.
8,998,091 B2 4/2015 Edmonds et al.
9,002,641 B2 4/2015 Showering
9,007,368 B2 4/2015 Laffargue et al.
9,010,641 B2 4/2015 Qu et al.
9,015,513 B2 4/2015 Murawski et al.
9,016,576 B2 4/2015 Brady et al.
D730,357 S 5/2015 Fitch et al.
9,022,288 B2 5/2015 Nahill et al.
9,030,964 B2 5/2015 Essinger et al.
9,033,240 B2 5/2015 Smith et al.
9,033,242 B2 5/2015 Gillet et al.
9,036,054 B2 5/2015 Koziol et al.
9,037,344 B2 5/2015 Chamberlin
9,038,911 B2 5/2015 Xian et al.
9,038,915 B2 5/2015 Smith
D730,901 S 6/2015 Oberpriller et al.
D730,902 S 6/2015 Fitch et al.
9,047,098 B2 6/2015 Barten
9,047,359 B2 6/2015 Caballero et al.
9,047,420 B2 6/2015 Caballero
9,047,525 B2 6/2015 Barber
9,047,531 B2 6/2015 Showering et al.
9,049,640 B2 6/2015 Wang et al.
9,053,055 B2 6/2015 Caballero
9,053,378 B1 6/2015 Hou et al.
9,053,380 B2 6/2015 Xian et al.
9,057,641 B2 6/2015 Amundsen et al.
9,058,526 B2 6/2015 Powilleit
9,061,527 B2 6/2015 Tobin et al.
9,064,165 B2 6/2015 Havens et al.
9,064,167 B2 6/2015 Xian et al.
9,064,168 B2 6/2015 Todeschini et al.
9,064,254 B2 6/2015 Todeschini et al.
9,066,032 B2 6/2015 Wang
9,070,032 B2 6/2015 Corcoran
D734,339 S 7/2015 Zhou et al.
D734,751 S 7/2015 Oberpriller et al.
9,076,459 B2 7/2015 Braho et al.
9,079,423 B2 7/2015 Bouverie et al.
9,080,856 B2 7/2015 Laffargue
9,082,023 B2 7/2015 Feng et al.
9,084,032 B2 7/2015 Rautiola et al.
9,087,250 B2 7/2015 Coyle
9,092,681 B2 7/2015 Havens et al.
9,092,682 B2 7/2015 Wilz et al.
9,092,683 B2 7/2015 Koziol et al.
9,093,141 B2 7/2015 Liu
9,098,763 B2 8/2015 Lu et al.
9,104,929 B2 8/2015 Todeschini
9,104,934 B2 8/2015 Li et al.
9,107,484 B2 8/2015 Chaney
9,111,159 B2 8/2015 Liu et al.
9,111,166 B2 8/2015 Cunningham
9,135,483 B2 9/2015 Liu et al.
9,137,009 B1 9/2015 Gardiner
9,141,839 B2 9/2015 Xian et al.
9,147,096 B2 9/2015 Wang
9,148,474 B2 9/2015 Skvoretz
9,158,000 B2 10/2015 Sauerwein
9,158,340 B2 10/2015 Reed et al.
9,158,953 B2 10/2015 Gillet et al.
9,159,059 B2 10/2015 Daddabbo et al.
9,165,174 B2 10/2015 Huck
9,171,543 B2 10/2015 Emerick et al.
9,183,425 B2 11/2015 Wang
9,189,669 B2 11/2015 Zhu et al.
9,195,844 B2 11/2015 Todeschini et al.
9,202,458 B2 12/2015 Braho et al.
9,208,366 B2 12/2015 Liu
9,208,367 B2 12/2015 Wang
9,219,836 B2 12/2015 Bouverie et al.
9,224,022 B2 12/2015 Ackley et al.
9,224,024 B2 12/2015 Bremer et al.
9,224,027 B2 12/2015 Van Horn et al.
D747,321 S 1/2016 London et al.
9,230,140 B1 1/2016 Ackley
9,235,553 B2 1/2016 Fitch et al.
9,239,950 B2 1/2016 Fletcher
9,245,492 B2 1/2016 Ackley et al.
9,443,123 B2 1/2016 Hejl
9,248,640 B2 2/2016 Heng
9,250,652 B2 2/2016 London et al.
9,250,712 B1 2/2016 Todeschini
9,251,411 B2 2/2016 Todeschini
9,258,033 B2 2/2016 Showering
9,262,633 B1 2/2016 Todeschini et al.
9,262,660 B2 2/2016 Lu et al.
9,262,662 B2 2/2016 Chen et al.
9,269,036 B2 2/2016 Bremer
9,270,782 B2 2/2016 Hala et al.
9,274,812 B2 3/2016 Doren et al.
9,275,388 B2 3/2016 Havens et al.
9,277,668 B2 3/2016 Feng et al.
9,280,693 B2 3/2016 Feng et al.
9,286,496 B2 3/2016 Smith
9,297,900 B2 3/2016 Jiang
9,298,964 B2 3/2016 Li et al.
9,301,427 B2 3/2016 Feng et al.
9,304,376 B2 4/2016 Anderson
9,310,609 B2 4/2016 Rueblinger et al.
9,313,377 B2 4/2016 Todeschini et al.
9,317,037 B2 4/2016 Byford et al.
D757,009 S 5/2016 Oberpriller et al.
9,342,723 B2 5/2016 Liu et al.
9,342,724 B2 5/2016 McCloskey
9,361,882 B2 6/2016 Ressler et al.
9,365,381 B2 6/2016 Colonel et al.
9,373,018 B2 6/2016 Colavito et al.
9,375,945 B1 6/2016 Bowles
9,378,403 B2 6/2016 Wang et al.
D760,719 S 7/2016 Zhou et al.
9,360,304 B2 7/2016 Chang et al.
9,383,848 B2 7/2016 Daghigh
9,384,374 B2 7/2016 Bianconi
9,390,596 B1 7/2016 Todeschini
D762,604 S 8/2016 Fitch et al.
9,411,386 B2 8/2016 Sauerwein
9,412,242 B2 8/2016 Van Horn et al.
9,418,269 B2 8/2016 Havens et al.
9,418,270 B2 8/2016 Van Volkinburg et al.
9,423,318 B2 8/2016 Lui et al.
D766,244 S 9/2016 Zhou et al.
9,443,222 B2 9/2016 Singel et al.
9,454,689 B2 9/2016 McCloskey et al.
9,464,885 B2 10/2016 Lloyd et al.
9,465,967 B2 10/2016 Xian et al.
9,478,113 B2 10/2016 Xie et al.
9,478,983 B2 10/2016 Kather et al.
D771,631 S 11/2016 Fitch et al.
9,481,186 B2 11/2016 Bouverie et al.
9,488,986 B1 11/2016 Solanki
9,489,782 B2 11/2016 Payne et al.
9,490,540 B1 11/2016 Davies et al.
9,491,729 B2 11/2016 Rautiola et al.
9,497,092 B2 11/2016 Gomez et al.
9,507,974 B1 11/2016 Todeschini
9,519,814 B2 12/2016 Cudzilo
9,521,331 B2 12/2016 Bessettes et al.

(56) References Cited

U.S. PATENT DOCUMENTS 9,530,038 B2 12/2016 Xian et al.
D777,166 S 1/2017 Bidwell et al.
9,558,386 B2 1/2017 Yeakley
9,572,901 B2 2/2017 Todeschini
9,606,581 B1 3/2017 Howe et al.
D783,601 S 4/2017 Schulte et al.
D785,617 S 5/2017 Bidwell et al.
D785,636 S 5/2017 Oberpriller et al.
9,646,189 B2 5/2017 Lu et al.
9,646,191 B2 5/2017 Unemyr et al.
9,652,648 B2 5/2017 Ackley et al.
9,652,653 B2 5/2017 Todeschini et al.
9,656,487 B2 5/2017 Ho et al.
9,659,198 B2 5/2017 Giordano et al.
D790,505 S 6/2017 Vargo et al.
D790,546 S 6/2017 Zhou et al.
9,680,282 B2 6/2017 Hanenburg
9,697,401 B2 7/2017 Feng et al.
9,701,140 B1 7/2017 Alaganchetty et al.
9,849,691 B1 * 12/2017 d'Armancourt ..... B41J 31/00
2005/0079298 A1 4/2005 Keeton et al.
2007/0063048 A1 3/2007 Havens et al.
2008/0217455 A1 9/2008 McNestry
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193423 A1 8/2012 Samek
2012/0203647 A1 8/2012 Smith
2012/0223141 A1 9/2012 Good et al.
2013/0043312 A1 2/2013 Van Horn
2013/0075168 A1 3/2013 Amundsen et al.
2013/0175341 A1 7/2013 Kearney et al.
2013/0175343 A1 7/2013 Good
2013/0215210 A1 8/2013 McNestry et al.
2013/0257744 A1 10/2013 Daghigh et al.
2013/0257759 A1 10/2013 Daghigh
2013/0270346 A1 10/2013 Xian et al.
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedraro
2013/0307964 A1 11/2013 Bremer et al.
2013/0308625 A1 11/2013 Park et al.
2013/0313324 A1 11/2013 Koziol et al.
2013/0332524 A1 12/2013 Fiala et al.
2014/0001267 A1 1/2014 Giordano et al.
2014/0002828 A1 1/2014 Laffargue et al.
2014/0025584 A1 1/2014 Liu et al.
2014/0100813 A1 1/2014 Showering
2014/0034734 A1 2/2014 Sauerwein
2014/0039693 A1 2/2014 Havens et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078342 A1 3/2014 Li et al.
2014/0098792 A1 4/2014 Wang et al.
2014/0100774 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0125853 A1 5/2014 Wang
2014/0125999 A1 5/2014 Longacre et al.
2014/0129378 A1 5/2014 Richardson
2014/0131443 A1 5/2014 Smith
2014/0131444 A1 5/2014 Wang
2014/0133379 A1 5/2014 Wang et al.
2014/0136208 A1 5/2014 Maltseff et al.
2014/0140585 A1 5/2014 Wang
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0168787 A1 6/2014 Wang et al.
2014/0175165 A1 6/2014 Havens et al.
2014/0191913 A1 7/2014 Ge et al.
2014/0197239 A1 7/2014 Havens et al.
2014/0197304 A1 7/2014 Feng et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0288933 A1 9/2014 Braho et al.
2014/0297058 A1 10/2014 Barker et al.
2014/0299665 A1 10/2014 Barber et al.
2014/0351317 A1 11/2014 Smith et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0009338 A1 1/2015 Laffargue et al.
2015/0014416 A1 1/2015 Kotlarsky et al.
2015/0021397 A1 1/2015 Rueblinger et al.
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0049347 A1 2/2015 Laffargue et al.
2015/0051992 A1 2/2015 Smith
2015/0053769 A1 2/2015 Thuries et al.
2015/0062366 A1 3/2015 Liu et al.
2015/0063215 A1 3/2015 Wang
2015/0088522 A1 3/2015 Hendrickson et al.
2015/0096872 A1 4/2015 Woodburn
2015/0100196 A1 4/2015 Hollifield
2015/0115035 A1 4/2015 Meier et al.
2015/0127791 A1 5/2015 Kosecki et al.
2015/0128116 A1 5/2015 Chen et al.
2015/0133047 A1 5/2015 Smith et al.
2015/0134470 A1 5/2015 Hejl et al.
2015/0136851 A1 5/2015 Harding et al.
2015/0142492 A1 5/2015 Kumar
2015/0144692 A1 5/2015 Hejl
2015/0144698 A1 5/2015 Teng et al.
2015/0149946 A1 5/2015 Benos et al.
2015/0161429 A1 6/2015 Xian
2015/0186703 A1 7/2015 Chen et al.
2015/0199957 A1 7/2015 Funyak et al.
2015/0210199 A1 7/2015 Payne
2015/0220753 A1 8/2015 Zhu et al.
2015/0254485 A1 9/2015 Feng et al.

(56) References Cited

U.S. PATENT DOCUMENTS

2015/0310243 A1 10/2015 Ackley
2015/0310389 A1 10/2015 Crimm et al.
2015/0327012 A1 11/2015 Bian et al.
2016/0014251 A1 1/2016 Hejl
2016/0040982 A1 2/2016 Li et al.
2016/0042241 A1 2/2016 Todeschini
2016/0057230 A1 2/2016 Todeschini et al.
2016/0062473 A1 3/2016 Bouchat et al.
2016/0092805 A1 3/2016 Geisler et al.
2016/0101936 A1 4/2016 Chamberlin
2016/0102975 A1 4/2016 McCloskey et al.
2016/0104019 A1 4/2016 Todeschini et al.
2016/0104274 A1 4/2016 Jovanovski et al.
2016/0109219 A1 4/2016 Ackley et al.
2016/0109220 A1 4/2016 Laffargue
2016/0109224 A1 4/2016 Thuries et al.
2016/0112631 A1 4/2016 Ackley et al.
2016/0112643 A1 4/2016 Laffargue et al.
2016/0117627 A1 4/2016 Raj et al.
2016/0124516 A1 5/2016 Schoon et al.
2016/0125217 A1 5/2016 Todeschini
2016/0125342 A1 5/2016 Miller et al.
2016/0133253 A1 5/2016 Braho et al.
2016/0171597 A1 6/2016 Todeschini
2016/0171666 A1 6/2016 McCloskey
2016/0171720 A1 6/2016 Todeschini
2016/0171775 A1 6/2016 Todeschini et al.
2016/0171777 A1 6/2016 Todeschini et al.
2016/0174674 A1 6/2016 Oberpriller et al.
2016/0178479 A1 6/2016 Goldsmith
2016/0178685 A1 6/2016 Young et al.
2016/0178707 A1 6/2016 Young et al.
2016/0179132 A1 6/2016 Harr et al.
2016/0179143 A1 6/2016 Bidwell et al.
2016/0179368 A1 6/2016 Roeder
2016/0179378 A1 6/2016 Kent et al.
2016/0180130 A1 6/2016 Bremer
2016/0180133 A1 6/2016 Oberpriller et al.
2016/0180136 A1 6/2016 Meier et al.
2016/0180594 A1 6/2016 Todeschini
2016/0180663 A1 6/2016 McMahan et al.
2016/0180678 A1 6/2016 Ackley et al.
2016/0180713 A1 6/2016 Bernhardt et al.
2016/0185126 A1 6/2016 McNestry et al.
2016/0185136 A1 6/2016 Ng et al.
2016/0185291 A1 6/2016 Chamberlin
2016/0186926 A1 6/2016 Oberpriller et al.
2016/0188861 A1 6/2016 Todeschini
2016/0188939 A1 6/2016 Sailors et al.
2016/0188940 A1 6/2016 Lu et al.
2016/0188941 A1 6/2016 Todeschini et al.
2016/0188942 A1 6/2016 Good et al.
2016/0188943 A1 6/2016 Linwood
2016/0188944 A1 6/2016 Wilz et al.
2016/0189076 A1 6/2016 Mellott et al.
2016/0189087 A1 6/2016 Morton et al.
2016/0189088 A1 6/2016 Percorari et al.
2016/0189092 A1 6/2016 George et al.
2016/0189284 A1 6/2016 Mellott et al.
2016/0189288 A1 6/2016 Todeschini
2016/0189366 A1 6/2016 Chamberlin et al.
2016/0189443 A1 6/2016 Smith
2016/0189447 A1 6/2016 Valenzuela
2016/0189489 A1 6/2016 Au et al.
2016/0191684 A1 6/2016 DiPiazza et al.
2016/0192051 A1 6/2016 DiPiazza et al.
2016/0125873 A1 7/2016 Braho et al.
2016/0202951 A1 7/2016 Pike et al.
2016/0202958 A1 7/2016 Zabel et al.
2016/0202959 A1 7/2016 Doubleday et al.
2016/0203021 A1 7/2016 Pike et al.
2016/0203429 A1 7/2016 Mellott et al.
2016/0203797 A1 7/2016 Pike et al.
2016/0203820 A1 7/2016 Zabel et al.
2016/0204623 A1 7/2016 Haggert et al.
2016/0204636 A1 7/2016 Allen et al.
2016/0204638 A1 7/2016 Miraglia et al.
2016/0316190 A1 7/2016 McCloskey et al.
2016/0227912 A1 8/2016 Oberpriller et al.
2016/0232891 A1 8/2016 Pecorari
2016/0288528 A1 10/2016 Matsuda
2016/0292477 A1 10/2016 Bidwell
2016/0294779 A1 10/2016 Yeakley et al.
2016/0306769 A1 10/2016 Kohtz et al.
2016/0314276 A1 10/2016 Sewell et al.
2016/0314294 A1 10/2016 Kubler et al.
2016/0323310 A1 11/2016 Todeschini et al.
2016/0325556 A1 11/2016 Ihara et al.
2016/0325677 A1 11/2016 Fitch et al.
2016/0327614 A1 11/2016 Young et al.
2016/0327930 A1 11/2016 Charpentier et al.
2016/0328762 A1 11/2016 Pape
2016/0330218 A1 11/2016 Hussey et al.
2016/0343163 A1 11/2016 Venkatesha et al.
2016/0343176 A1 11/2016 Ackley
2016/0364914 A1 12/2016 Todeschini
2016/0370220 A1 12/2016 Ackley et al.
2016/0372282 A1 12/2016 Bandringa
2016/0373847 A1 12/2016 Vargo et al.
2016/0377414 A1 12/2016 Thuries et al.
2016/0377417 A1 12/2016 Jovanovski et al.
2017/0010141 A1 1/2017 Ackley
2017/0010328 A1 1/2017 Mullen et al.
2017/0010780 A1 1/2017 Waldron et al.
2017/0016714 A1 1/2017 Laffargue et al.
2017/0018094 A1 1/2017 Todeschini
2017/0046603 A1 2/2017 Lee et al.
2017/0047864 A1 2/2017 Stang et al.
2017/0053146 A1 2/2017 Liu et al.
2017/0053147 A1 2/2017 Geramine et al.
2017/0053647 A1 2/2017 Nichols et al.
2017/0055606 A1 3/2017 Xu et al.
2017/0060316 A1 3/2017 Larson
2017/0061961 A1 3/2017 Nichols et al.
2017/0064634 A1 3/2017 Van Horn et al.
2017/0083730 A1 3/2017 Feng et al.
2017/0091502 A1 3/2017 Furlong et al.
2017/0091706 A1 3/2017 Lloyd et al.
2017/0091741 A1 3/2017 Todeschini
2017/0091904 A1 3/2017 Ventress
2017/0092908 A1 3/2017 Chaney
2017/0094238 A1 3/2017 Germaine et al.
2017/0098947 A1 4/2017 Wolski
2017/0100949 A1 4/2017 Celinder et al.
2017/0108838 A1 4/2017 Todeschinie et al.
2017/0108895 A1 4/2017 Chamberlin et al.
2017/0118355 A1 4/2017 Wong et al.
2017/0123598 A1 5/2017 Phan et al.
2017/0124369 A1 5/2017 Rueblinger et al.
2017/0124396 A1 5/2017 Todeschini et al.
2017/0124687 A1 5/2017 McCloskey et al.
2017/0126873 A1 5/2017 McGary et al.
2017/0126904 A1 5/2017 d'Armancourt et al.
2017/0139012 A1 5/2017 Smith
2017/0140329 A1 5/2017 Bernhardt et al.
2017/0140731 A1 5/2017 Smith
2017/0147847 A1 5/2017 Berggren et al.
2017/0150124 A1 5/2017 Thuries
2017/0169198 A1 6/2017 Nichols
2017/0171035 A1 6/2017 Lu et al.
2017/0171703 A1 6/2017 Maheswaranathan
2017/0171803 A1 6/2017 Maheswaranathan
2017/0180359 A1 6/2017 Wolski et al.
2017/0180577 A1 6/2017 Nguon et al.
2017/0181299 A1 6/2017 Shi et al.
2017/0190192 A1 7/2017 Delario et al.
2017/0193432 A1 7/2017 Bernhardt
2017/0193461 A1 7/2017 Jonas et al.
2017/0193727 A1 7/2017 Van Horn et al.
2017/0200108 A1 7/2017 Au et al.
2017/0200275 A1 7/2017 McCloskey et al.

* cited by examiner

DETECTING PRINTING RIBBON ORIENTATION

CROSS-REFERENCE TO RELATED APPLICATION

The present application claims the benefit of U.S. patent application Ser. No. 15/416,606 for Detecting Printing Ribbon Orientation filed Jan. 26, 2017, which is hereby incorporated by reference in its entirety.

FIELD OF THE INVENTION

The present disclosure relates to devices, systems, and methods providing a ribbon sensor configured and positioned to ascertain an orientation of a printing ribbon, including devices, systems, and methods configured for detecting an improperly oriented printing ribbon, and for triggering a response in the event of an improperly installed, and/or for confirming proper installation of a printing ribbon.

BACKGROUND

There are numerous examples of printers and other printing devices which utilize a printing ribbon to transfer ink to a printing media. A printing ribbon typically includes a substrate, and a functional layer which includes a coloring agent or an ink that is applied to printing media during printing. For example, a thermal transfer printer can use a printing ribbon that has a substrate and a functional layer having a thermally sensitive ink that reacts and transfers from the printing ribbon to the media upon exposure to heat from a print head.

Printing ribbons are generally removably installed in a printer. As having a finite length, spent printing ribbons need to be replenished with fresh printing ribbons as and when consumed. The task of replenishing a printer with a fresh printing ribbon is typically carried out manually, which introduces the possibility for human error. Thus, sometimes a printing ribbon may be incorrectly installed or improperly oriented in a printer. Additionally, sometimes the wrong printing ribbon might be installed in a printer. Even with an automated system for replenishing a printing ribbon, the possibility for error still exists. Typically, a printing ribbon will be provided as wound upon a spool, with the ribbon unwinding and passing the functional layer facing and in proximity to and between the print head and the printing media during printing. If a printing ribbon happens to be installed with an improper orientation, then the substrate will face the printing media instead of the functional layer, and the printer and printing ribbon will not function as intended to transfer ink from the functional layer to the media. Additionally, a printer and printing ribbon may not function as intended when the printing ribbon installed in the printer happens to be the wrong printing ribbon for the printer or for an intended print job.

In some situations, it can be difficult to identify the proper orientation for a printing ribbon when installing the printing ribbon in a printer. For example, some users may struggle to distinguish the functional layer from a substrate of a printing ribbon and then remain mindful of which orientation to install the printing ribbon so that the functional layer faces the printing media when properly installed. This can be an issue particularly in environments with poor lighting or where operators are busy. Additionally, sometimes a printing ribbon may have a configuration such that a user cannot see the functional layer in a fresh spool or cartridge. For example, sometimes a printing ribbon can be wound inside a protective wrapper or casing, and/or a leader of ribbon may be provided which does not contain any coloring agent or ink. Moreover, printing ribbons are available as both an inwound spool, meaning the functional layer faces inward the spool, and as an outwound spool, meaning the functional layer faces outward the spool. Additionally, there are numerous different kinds of printing ribbons many of which can look alike. These various combinations and alternatives add compounding sources of error, further increasing the possibility for a printing ribbon to be installed with an improper orientation or for the wrong printing ribbon to be installed in a printer. Even further, sometimes there will exist a nominal level of errors which tend to happen despite all the best intentions.

The cost associated with even periodic improperly oriented or otherwise incorrectly installed printing ribbons can be significant, especially in high-volume production environments. Sometimes a printer may process print jobs with an improperly oriented or incorrect printing ribbon, resulting in wasted ribbon and printing media. There are also costs associated with downtime and rework resulting from an improperly oriented printing ribbon or an incorrect printing ribbon having been installed. Additionally, in some settings these issues may go unnoticed for quite some time, and/or a user may be unable to quickly respond and correct these issues.

At least in view of the foregoing issues and shortcomings, there exists a need for improved devices, systems. The present disclosure addresses the foregoing issues and shortcomings, for example, by providing devices, systems, and methods configured for detecting an improperly oriented printing ribbon and/or an incorrect printing ribbon having been installed, including devices, systems, and methods configured to trigger a response in the event of an improperly oriented or incorrect printing ribbon and/or to confirm proper installation of a printing ribbon. Additionally provided are devices, systems, and methods configured to provide proper installation of a printing ribbon and to ascertain an orientation of a printing ribbon and/or to identify a printing ribbon.

SUMMARY

Accordingly, in one aspect, the present disclosure embraces devices, systems, and methods configured for ascertaining an orientation of a printing ribbon and/or identifying a printing ribbon having been installed.

In an exemplary embodiment, a printer is provided with a printing ribbon installed along a printing ribbon path configured to guide the printing ribbon between a print head and a media. The printer includes a ribbon sensor positioned along the printing ribbon path facing a surface of the printing ribbon. The ribbon sensor can be configured to sense any one or more properties of a printing ribbon, and to ascertain whether a functional layer or a substrate of the printing ribbon faces the ribbon sensor, and/or to identify a printing ribbon from among a plurality. A ribbon sensor can sense any property of the printing ribbon by which the functional layer can be distinguished from the substrate, and/or whereby a printing ribbon can be identified from among a plurality of printing ribbons. For example, a ribbon sensor can be configured to sense an optical property of a printing ribbon, an electrical property of a printing ribbon, and/or a magnetic property of a printing ribbon. A ribbon sensor including an LED light source paired with a photodiode or a phototransistor can be configured to ascertain a reflectance value for a printing ribbon.

The printing ribbon has a first surface comprising a substantially specular substrate having a first reflectivity and a second surface comprising a substantially diffuse functional layer having a second reflectivity. Typically, the first reflectivity will be greater than the second reflectivity. Exemplary devices, systems, and methods are configured to detect with the ribbon sensor, a reflectance value from the printing ribbon. The reflectance value can be used to ascertain that the first surface faces the ribbon sensor when the reflectance value detected corresponds to a substantially specular reflectance as expected from the first surface, and/or to ascertain that the functional layer faces the ribbon sensor when the reflectance value detected corresponds to a substantially diffuse reflectance as expected from the second surface. The reflectance value can also be used to identify a printing ribbon having been installed in the printer from among a plurality of printing ribbons, based at least in part on the respective printing ribbons from among the plurality exhibiting different reflectance values relative to one another.

In some embodiments, exemplary devices, systems, and methods can be configured to ascertain, based at least in part on a reflectance value detected with the ribbon sensor, whether the printing ribbon as installed along the printing ribbon path is properly oriented with a first surface facing the print head and a second surface facing the media as intended. Exemplary devices, systems, and methods can be configured to identify a printing ribbon based at least in part on a reflectance value detected with the ribbon sensor. The reflectance value can be compared to a defined value, a threshold, or a range as appropriate for a given embodiment. In some embodiments, a substantially specular reflectance as expected from a substrate of a printing ribbon may differ from a substantially diffuse reflectance as expected from a functional layer by 10% or more. A response can be triggered upon having ascertained, based at least in part on the reflectance value detected, that the printing ribbon as installed along the printing ribbon path is not properly oriented. The response can include an audible alert, a visual alert, a stop print command, re-routing one or more print jobs to a different printer, and/or requesting a standby printer.

In various embodiments, a printer can be configured such that either the ribbon sensor faces the first surface of a properly oriented printing ribbon or such that the ribbon sensor faces the second surface of a properly oriented printing ribbon. A printing ribbon can be wound upon a spool, which may be an inwound spool, in which the functional surface of the printing ribbon faces inwardly the spool, or and outwound spool, in which the functional surface of the printing ribbon faces outwardly the spool. Exemplary devices, systems, and methods can be configured to provide an indication that the printing ribbon as installed along the printing ribbon path is improperly oriented and/or that the printing ribbon as installed along the printing path is properly oriented. In some embodiments, the printing ribbon can be a thermal transfer ribbon, including a substrate made up of a polyester film, a synthetic resin, and/or a silicone coating, and or including a functional layer made up of a thermoplastic resin, an epoxy resin, a wax, and/or a sensible material including a coloring agent or an ink. The present disclosure also embraces various other kinds of printing ribbons.

In another embodiment, a printer is provided with a ribbon sensor positioned and configured to face a surface of a printing at least partially installed in the printer. Exemplary devices, systems, and methods can be configured to ascertain that a substrate of the printing ribbon faces the ribbon sensor when the ribbon sensor returns a reflectance value corresponding to a reflectance as expected from a substrate; and/or to ascertain that a thermal transfer layer of the printing ribbon faces the ribbon sensor when the ribbon sensor returns a reflectance value corresponding to a reflectance as expected from a thermal transfer layer. The substrate may have a substantially specular reflectance, and the thermal transfer layer may have a substantially diffuse reflectance. The reflectance as expected from the substrate may differ from the reflectance as expected from the thermal transfer layer by 10% or more. The ribbon sensor may be configured so as to face the substrate when the printing ribbon is properly oriented, or so as to face the thermal transfer layer when the printing ribbon is properly oriented. A response can be triggered when the ribbon sensor returns a reflectance value indicating that that the printing ribbon is improperly oriented. The response can include an audible alert, a visual alert, a stop print command, re-routing one or more print jobs to a different printer, and/or requesting a standby printer.

In another embodiment, a printer is provided with a print head configured to transfer an ink from a printing ribbon to a media, and with a ribbon sensor configured to detect a reflectance value from the printing ribbon to be utilized by the printer. Exemplary devices, systems, and methods can be configured to detect with the ribbon sensor, a reflectance value from the printing ribbon when at least partially installed in the printer. The printing ribbon has a substrate and a functional layer comprising the ink; and exemplary devices, systems, and methods can be configured to ascertain that the substrate faces the ribbon sensor when the reflectance value corresponds to a substantially specular reflectance, and/or to ascertain that the thermal transfer layer faces the ribbon sensor when the reflectance value corresponds to a substantially diffuse reflectance. In some embodiments, exemplary devices, systems, and methods can be configured to ascertain based at least in part on the reflectance value detected with the ribbon sensor, whether the at least partially installed printing ribbon is properly oriented such that when having commenced printing, the substrate will face the print head and the thermal transfer layer will face the media. The reflectance value corresponding to a substantially specular reflectance can differ from the reflectance value corresponding to a substantially diffuse reflectance by 10% or more. In some embodiments, a ribbon sensor can be configured to identify a printing ribbon from among a plurality of printing ribbons based at least in part on a reflectance value.

In some embodiments, the ribbon sensor faces the substrate when the printing ribbon is properly oriented. An indication can be provided, indicating that the printing ribbon is improperly oriented when having ascertained that the thermal transfer layer improperly faces the ribbon sensor. Additionally or alternatively, an indication can be provided, indicating that the printing ribbon is properly oriented when having ascertained that the substrate properly faces the ribbon sensor. A response can be triggered upon having ascertained, based at least in part on the reflectance value detected with the ribbon sensor, that the at least partially installed printing ribbon is not properly oriented. The response can include an audible alert, a visual alert, a stop print command, re-routing one or more print jobs to a different printer, and/or requesting a standby printer.

The foregoing summary is illustrative only, and is not intended to be in any way limiting. In addition to the illustrative features and embodiments described above, further aspects, features, and embodiments will become apparent by references to the drawings, the following detailed description, and the claims.

DETAILED DESCRIPTION

In the following detailed description, various aspects and features are described in greater detail with reference to the accompanying figures, including among other aspects and features, exemplary devices, systems, and methods configured to ascertain an orientation of a printing ribbon, to provide proper installation of a printing ribbon, to trigger a response in the event of an improperly installed printing ribbon and/or to confirm proper installation of a printing ribbon. Additionally described are exemplary devices, systems, and methods configured to identify a printing ribbon from among a plurality of printing ribbons. Numerous specific details are set forth in order to provide a thorough understanding of the present disclosure. It will be apparent, however, to one skilled in the art that the presently disclosed devices, systems, and methods may be performed without some or all of these specific details. In other instances, well known aspects have not been described in detail in order not to unnecessarily obscure the present disclosure. The following detailed description is therefore not to be taken in a limiting sense, and it is intended that other embodiments are within the spirit and scope of the present disclosure.

Printer Configurations and Printing Ribbons

There are numerous examples of printers and other printing devices which utilize a printing ribbon to transfer a coloring agent or ink to a printing media, some of which are discussed herein. There are also numerous examples of printing ribbons, some of which are discussed herein. A printing ribbon typically includes a substrate, and a functional layer which includes a coloring agent or ink that is applied to printing media during printing. For example, a thermal transfer printer uses a printing ribbon that typically has a substrate, and a functional layer or thermal transfer layer having a thermally sensitive ink that reacts and transfers from the printing ribbon to the media upon exposure to heat from a print head. A dye-sublimation printer uses a similarly configured printing ribbon. Additional exemplary printing ribbons include fabric printing ribbons that contain a liquid ink, and impact printing ribbons for use with impact printers such as dot-matrix printers or typewriters. In some embodiments, a printing ribbon can be transported in parallel with the media. Alternatively, a printing ribbon can be transported perpendicular to the media. Some exemplary printer configurations and printing ribbons and are discussed in further detail below. While the present disclosure discusses only an exemplary selection of the possible kinds of printers and printing ribbons, those skilled in the art will appreciate that numerous other kinds of printers and printing ribbons can be configured in accordance with the devices, systems, and methods disclosed herein, all of which are within the spirit and scope of the present disclosure.

Figure 1A:
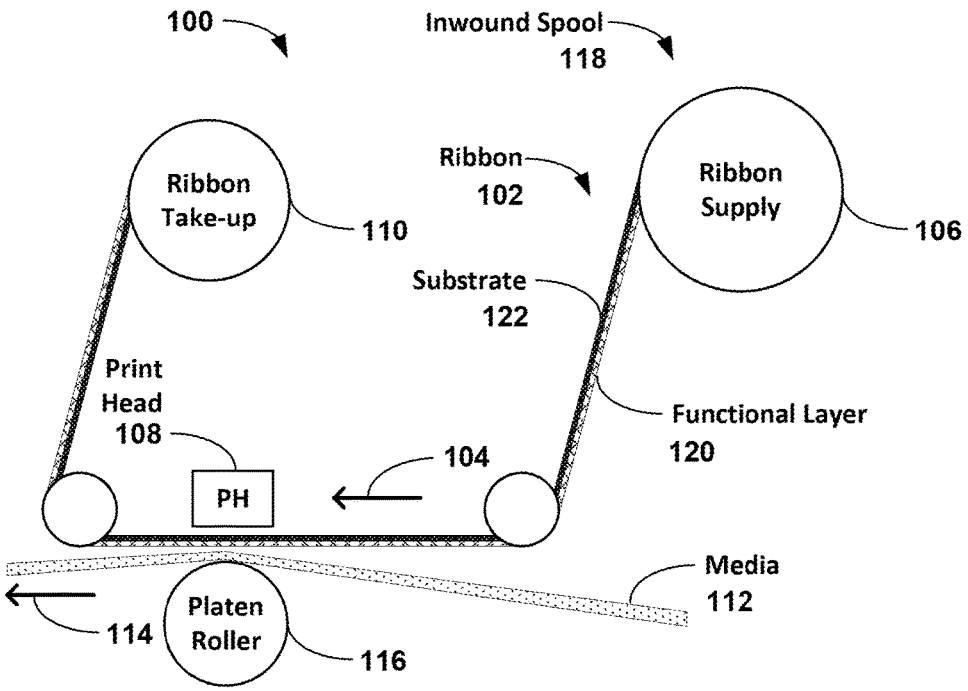
FIG. 1A schematically depicts an exemplary printing device with an inwound printing ribbon properly installed.
Figure 1B:
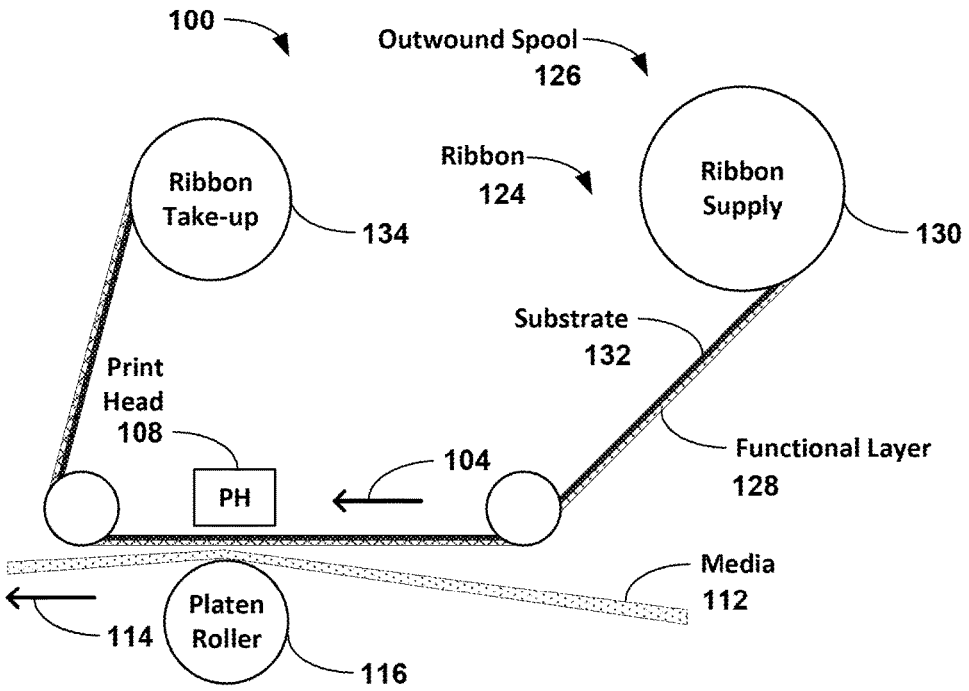
FIG. 1B schematically depicts an exemplary printing device with an outwound printing ribbon properly installed.

In accordance with the present disclosure, printing devices and printing systems are provided which have a ribbon sensor positioned along the printing ribbon path and configured to ascertain an orientation of the printing ribbon and/or to identify a printing ribbon from among a plurality. FIGS. 1A and 1B schematically depict an exemplary printing device. In some embodiments, the exemplary printing device can be a thermal transfer printer. Alternatively, the printing device can be a dye-sublimation printer or any other kind of printing device that uses a printing ribbon. As shown in FIG. 1A, an exemplary printing device 100 is provided. The printing device has a printing ribbon 102 which follows a ribbon path 104 leading from a ribbon supply spool 106 past a print head 108 and to a ribbon take-up spool 110. A printing media 112 follows a media supply path 114 between a platen roller 116 and the print head 108. As shown in FIG. 1A, the printing ribbon is supplied from an inwound spool 118, which printing ribbon is sometimes referred to herein as an inwound printing ribbon, meaning that the printing ribbon 102 has a functional layer 120 that faces inward the ribbon supply spool 106, and a substrate 122 that faces outward the spool. The print head 108 is configured to transfer ink from the functional layer 120 to the media 112. Accordingly, the printing ribbon 102 is properly oriented, with the functional layer 120 facing the media 112 as both pass between the print head 108 and the platen roller 116.

FIG. 1B shows the same exemplary printing device 100 of FIG. 1A, except that rather than an inwound spool 118, the printing ribbon 124 is supplied from an outwound spool 126, which printing ribbon is sometimes referred to herein as an outwound printing ribbon, meaning that the printing ribbon 124 has a functional layer 128 that faces inward the ribbon supply spool 130, and a substrate 132 that faces outward the spool. The printing ribbon 124 similarly follows the ribbon path 104 leading from the ribbon supply spool 130 past the print head 108 and to a ribbon take-up spool 110. The printing media 112 similarly follows the media supply path 114 between the platen roller 116 and the print head 108. As with the inwound spool in FIG. 1A, the outwound spool 126 shown in FIG. 1B provides the printing ribbon 124 properly oriented with the functional layer 128 facing the media 112 as both pass between the print head 108 and the platen roller 116, thereby allowing the print head 108 to transfer ink from the functional layer 128 to the media 112.

Thus, as shown in FIGS. 1A and 1B, the functional layer of a properly installed printing ribbon faces the media 112, thereby allowing the print head 108 to transfer ink from the functional layer to the media when printing. The inwound spool 118 and the outwound spool 126 are installed with opposite orientations relative to one another, such that they rotate in opposite directions relative to one another when unwinding. With the configuration of the exemplary printing device 100 shown in FIGS. 1A and 1B, a properly oriented inwound spool 118 rotates counter-clockwise, unwinding from the top, and a properly oriented outwound spool 126 rotates clockwise, unwinding from the bottom. Conversely, with an improperly oriented printing ribbon the functional layer faces away from the media, which would typically prevent the print head from transferring ink from the functional layer to the media.

An improperly oriented printing ribbon can be detected by providing a printer equipped with a ribbon sensor in accordance with the present disclosure. As discussed in more detail below, a ribbon sensor can ascertain an orientation of a printing ribbon when the printing ribbon has a functional layer and a substrate that have at least one property that a ribbon sensor can be configured to detect which differs as between the functional layer and the substrate in at least one respect. A response can be triggered when the ribbon sensor detects an improperly oriented printing ribbon and/or an indication can be provided to confirm the proper orientation of a printing ribbon. Accordingly, exemplary printers are provided which have a ribbon sensor configured and positioned to ascertain an orientation of the printing ribbon. For example, as shown in FIGS. 2A-2D, an exemplary printing device 100 has a ribbon sensor 200 configured and positioned to ascertain an orientation of a printing ribbon. Any suitable configuration and position can be provided. In some embodiments, the ribbon sensor 200 can be positioned at any suitable location along the printing ribbon path 104.

Figure 2A:
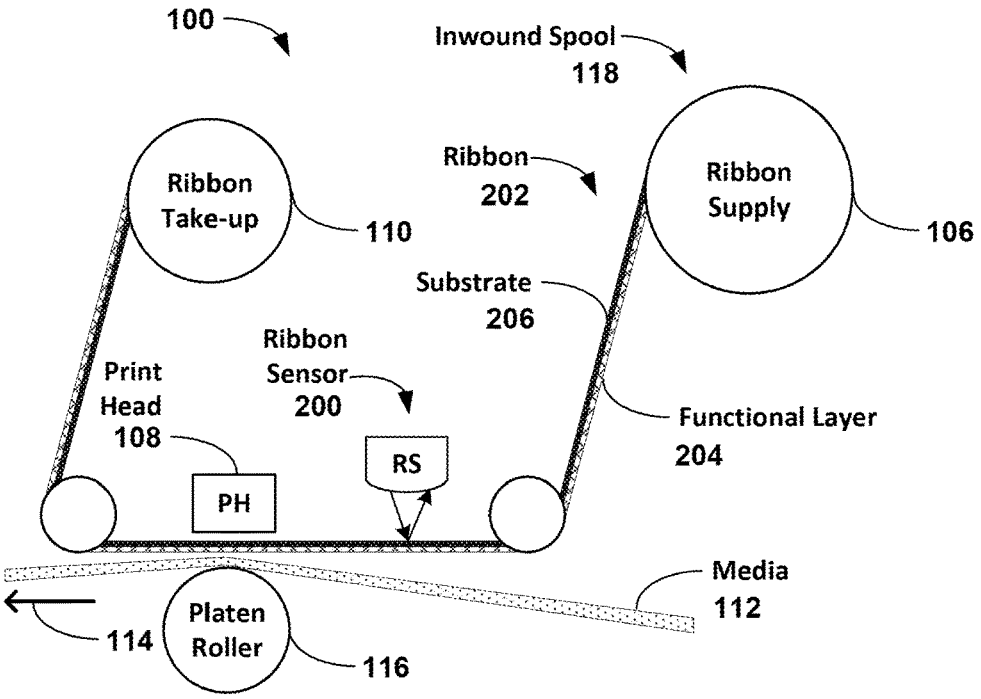
FIG. 2A schematically depicts an exemplary printing device with a ribbon sensor configured to ascertain an orientation of a printing ribbon, with a properly oriented inwound printing ribbon.
Figure 2B:
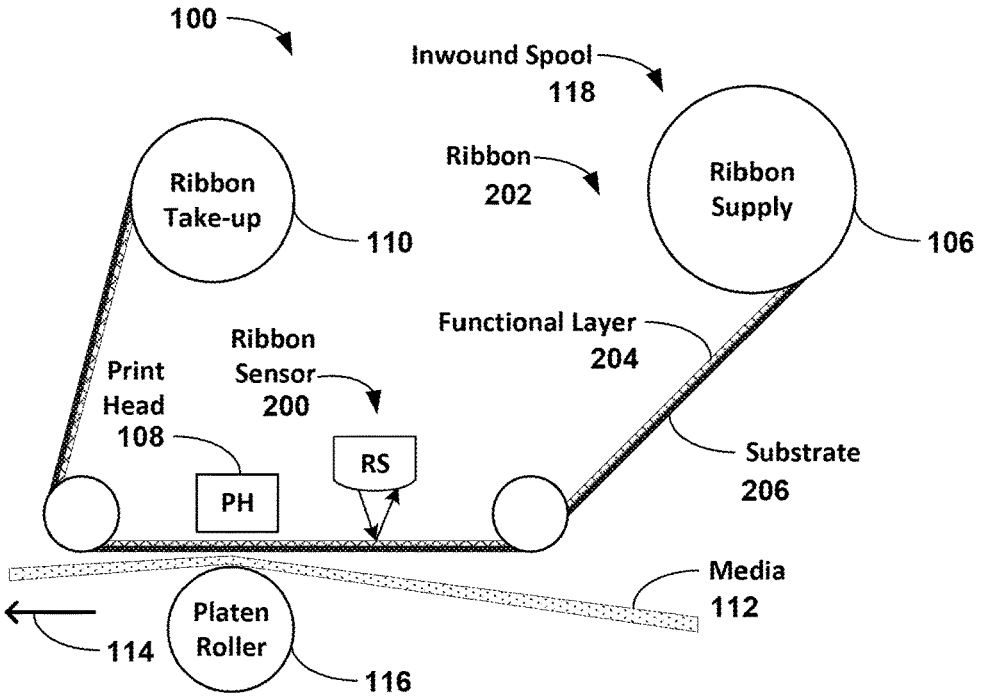
FIG. 2B schematically depicts an exemplary printing device with a ribbon sensor configured to ascertain an orientation of a printing ribbon, with an improperly oriented inwound printing ribbon.
Figure 2C:
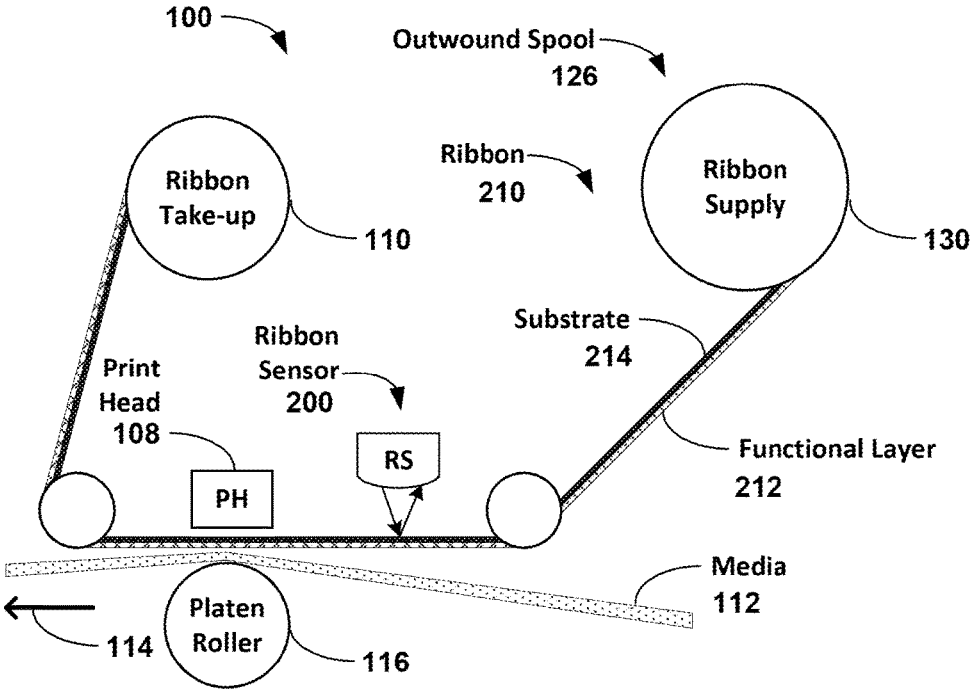
FIG. 2C schematically depicts an exemplary printing device with a ribbon sensor configured to ascertain an orientation of a printing ribbon, with a properly oriented outwound printing ribbon.
Figure 2D:
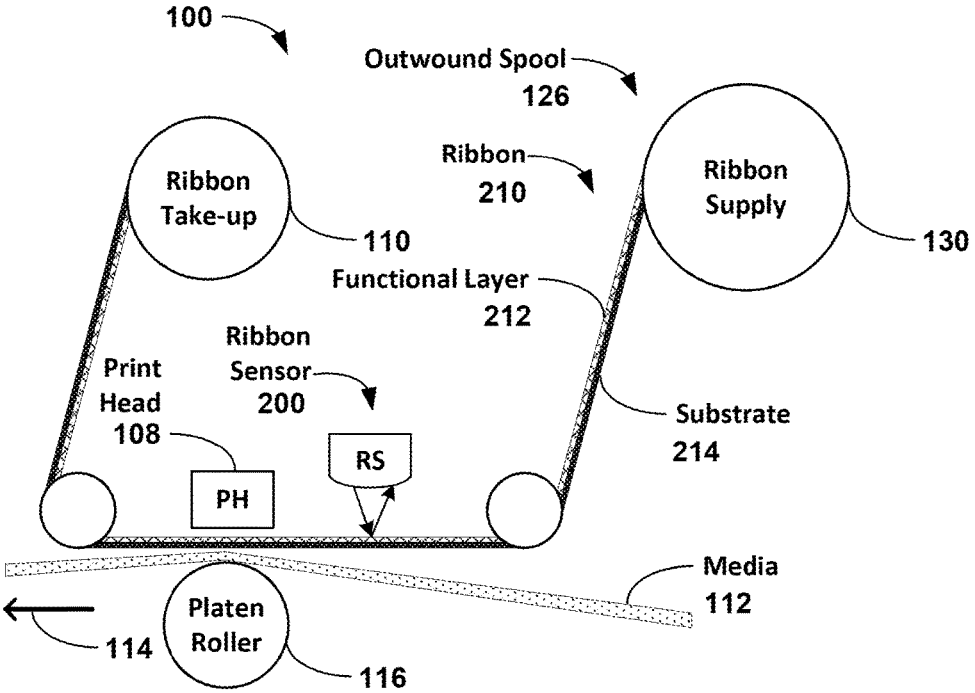
FIG. 2D schematically depicts an exemplary printing device with a ribbon sensor configured to ascertain an orientation of a printing ribbon, with an improperly oriented outwound printing ribbon.

FIG. 2A shows an exemplary printing device 100 with a properly oriented inwound printing ribbon 202, and FIG. 2B shows the exemplary printing device 100 with an improperly oriented inwound printing ribbon 204. Conversely, FIG. 2C shows the exemplary printing device 100 with a properly oriented outwound printing ribbon 210, and FIG. 2D shows the exemplary printing device 100 with an improperly oriented inwound printing ribbon 216. As shown in FIGS. 2A-2D, the ribbon sensor 200 is located on the substrate-side of a properly oriented printing ribbon. Thus, with a properly oriented printing ribbon 202/210 in the configuration shown in FIGS. 2A and 2C, the substrate 206/214 faces the ribbon sensor 200. Conversely, with an improperly oriented printing ribbon 204/216 in the configuration shown in FIGS. 2B and 2D, the functional layer 208/220 faces the ribbon sensor 200. Other configurations also can be provided, several of which are discussed below.

As shown in FIG. 2A an exemplary printing device 100 has a properly oriented inwound printing ribbon 202. When properly oriented, an inwound spool 118 rotates counter-clockwise, unwinding from the top. As the inwound printing ribbon 202 proceeds along the ribbon path 114, the functional layer 208 faces the media 112 at the platen roller 116, and the substrate 206 faces the ribbon sensor 200 as configured in FIG. 2A. Thus, a properly oriented inwound printing ribbon 202 can be ascertained when the ribbon sensor 200 as configured in FIG. 2A detects the substrate 206 facing the ribbon sensor. By contrast, as shown in FIG. 2B the exemplary printing device 100 has an improperly oriented inwound printing ribbon 204. When improperly oriented, the inwound spool 118 rotates in a clockwise direction, unwinding from the bottom. As the improperly oriented inwound printing ribbon proceeds along the ribbon path 114, the substrate 206 faces the media 112 at the platen roller 116, and the functional layer 208 faces the ribbon sensor 200 as configured in FIG. 2B and opposite the media 112. Thus, an improperly oriented inwound printing ribbon 204 can be ascertained when the ribbon sensor 200 as configured in FIG. 2B detects the functional layer 208 facing the ribbon sensor.

Conversely, as shown in FIG. 2C, a properly oriented outwound printing ribbon 210 rotates in the opposite direction as the properly oriented inwound printing ribbon 202 shown in FIG. 2A. Here, FIG. 2C again shows the exemplary printing device 100, but this time with an outwound printing ribbon 210 properly oriented. The outwound spool 126 unwinds from the top, rotating counter-clockwise when properly oriented as shown in FIG. 2C. As the outwound printing ribbon 210 proceeds along the ribbon path 114, similar to the properly oriented inwound printing ribbon, the functional layer 212 of the outwound printing ribbon faces the media 112 at the platen roller 116, and the substrate 214 faces the ribbon sensor 200 as configured in FIG. 2C. Thus, a properly oriented outwound printing ribbon 210 can be ascertained when the ribbon sensor 200 as configured in FIG. 2C detects the substrate 214 facing the ribbon sensor. By contrast, FIG. 2D shows the exemplary printing device 100 with an improperly oriented outwound printing ribbon 216. The outwound spool 126 unwinds from the bottom, rotating in a clockwise direction. As the outwound printing ribbon proceeds along the ribbon path 114, the substrate 214 faces the media 112 at the platen roller 116, and the functional layer 212 faces the ribbon sensor 200 as configured in FIG. 2D. Thus, an improperly oriented outwound printing ribbon 216 can be ascertained when the ribbon sensor 200 as configured in FIG. 2D detects the functional layer 212 facing the ribbon sensor.

In some embodiments, an exemplary printing device 100 can be configured to identify a printing ribbon from among a plurality of printing ribbons by providing a ribbon sensor in accordance with the present disclosure. As discussed in more detail below, a ribbon sensor can be configured to identify a printing ribbon from among a plurality of printing ribbons when the printing ribbons among the plurality have at least one property that a ribbon sensor can be configured to detect which differs as among the plurality of printing ribbons. A response can be triggered when the ribbon sensor detects the wrong printing ribbon being installed and/or an indication can be provided to confirm the proper printing ribbon is installed.

Figure 3A:
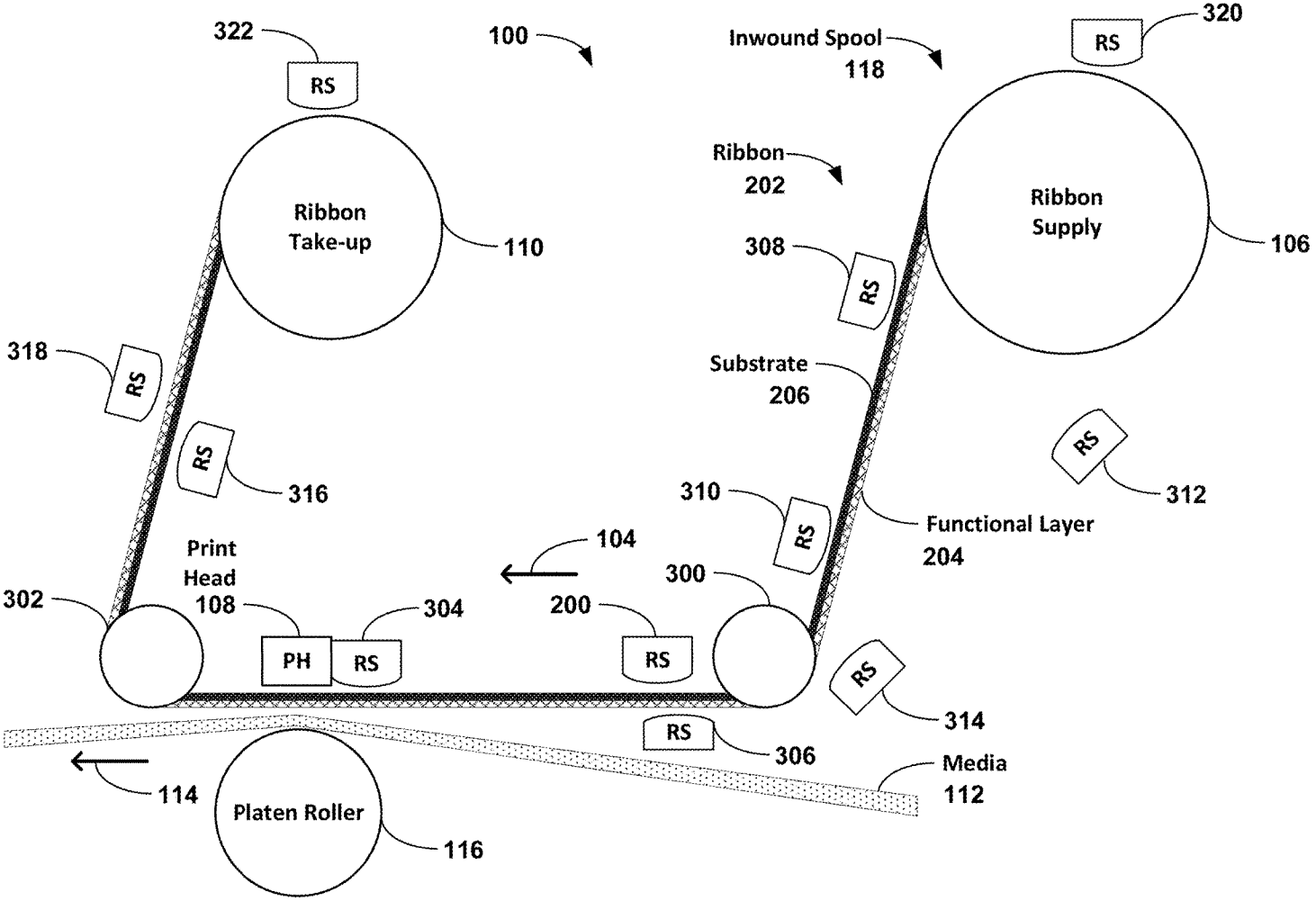
FIGS. 3A and 3B schematically depict exemplary locations for a ribbon sensor, respectively showing a properly oriented inwound printing ribbon and a properly oriented outwound printing ribbon.
Figure 3B:
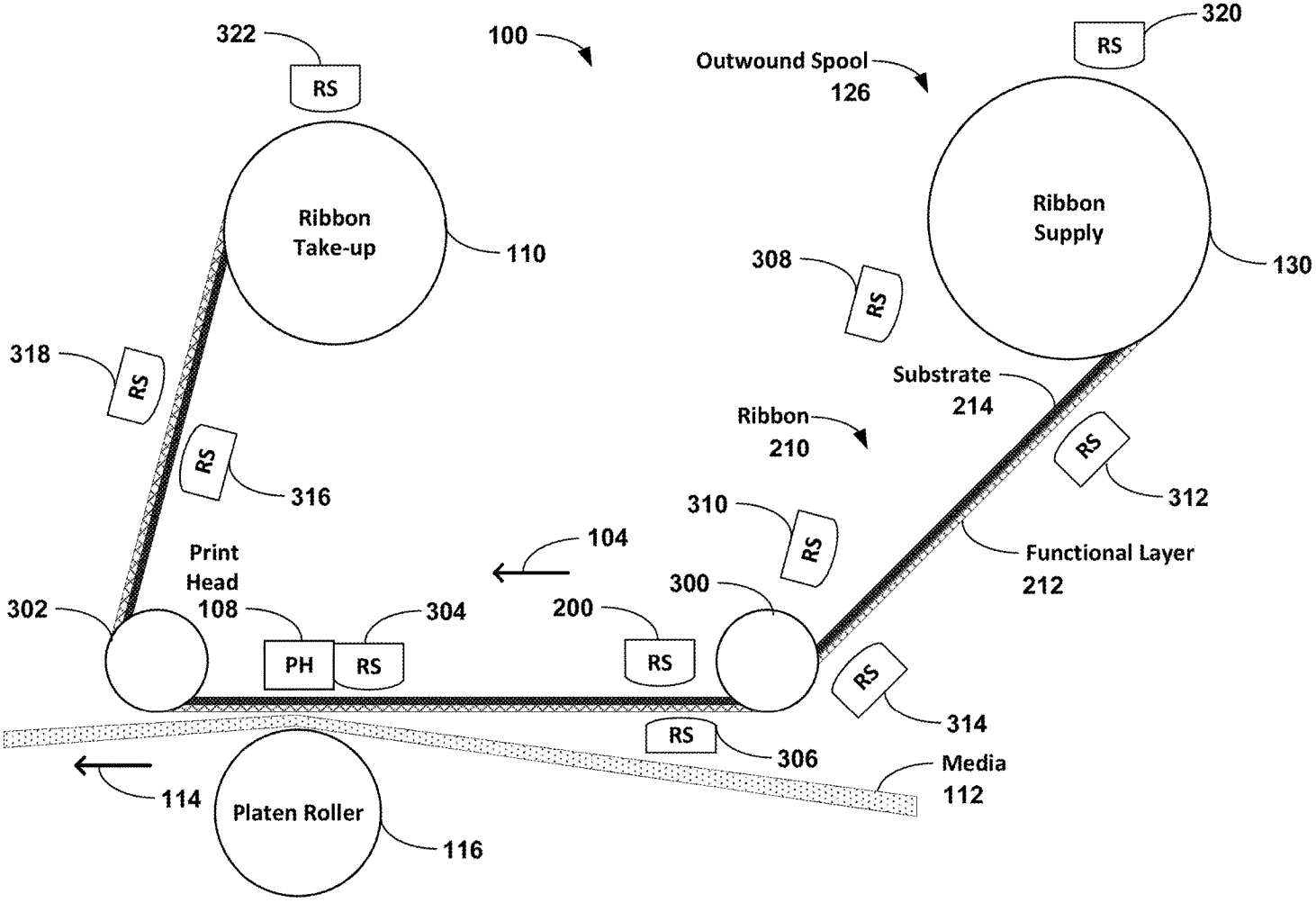

In addition to the ribbon sensor location shown in FIGS. 2A-2D, a ribbon sensor can be located at any suitable position along a ribbon path 104. Thus, other configurations also can be provided, several of which are discussed below. In an exemplary embodiment, a ribbon sensor can be located on the substrate-side, and configured such that the ribbon sensor can detect the substrate of a properly oriented printing ribbon. Alternatively, a ribbon sensor can be located on the functional layer-side of a properly oriented printing ribbon, such that the ribbon sensor can detect the functional layer of a properly oriented printing ribbon. As examples, FIGS. 3A and 3B show several exemplary ribbon sensor locations and configurations. FIG. 3A shows an exemplary printing device 100, with a properly oriented inwound spool 118, and FIG. 3B shows the exemplary printing device 100 with a properly oriented outwound spool 126. Additional ribbon sensor locations will be apparent to those skilled in the art, all of which are within the spirit and scope of the present disclosure.

Figure 4:
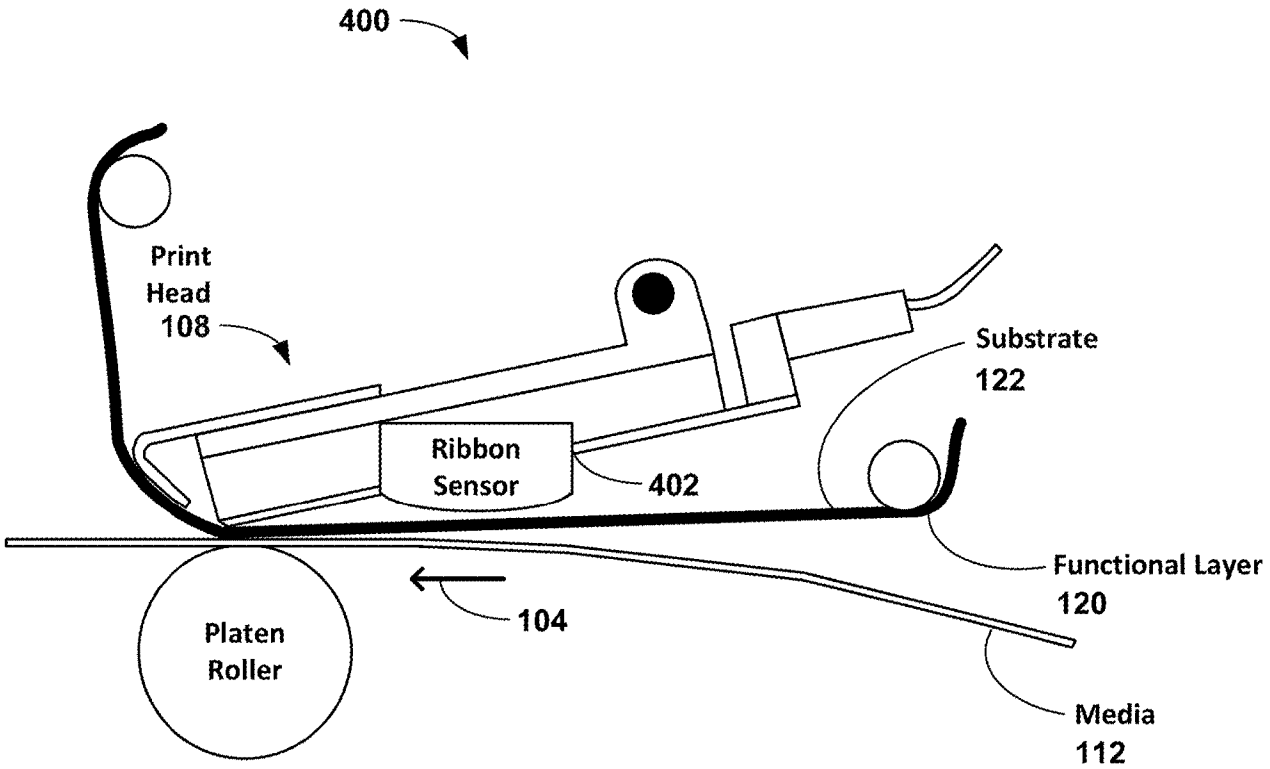
FIG. 4 schematically depicts an exemplary embodiment of an integrated component including a print head and a ribbon sensor.

As shown in FIGS. 3A and 3B, in some embodiments a ribbon sensor can be situated at a location on the substrate-side along a portion of the ribbon path leading to the print head 108, for example at a location between a leading tension roller 300 and a trailing tension roller 302. A ribbon sensor may have improved accuracy when located between the tension rollers because tension provided by the tension rollers can help maintain a uniform distance between the printing ribbon and the ribbon sensor. Conversely, areas where a printing ribbon would be expected to have low tension may be less suitable for locating a ribbon sensor because low tension can cause a varying distance between the printing ribbon and the ribbon sensor, leading to decreased accuracy in the values obtained from the ribbon sensor. The ribbon sensor 200 shown in FIGS. 2A-2D (also shown in FIGS. 3A and 3B) provides one example of a ribbon sensor located between tension rollers. Any location between the tension rollers 300/302 may be suitable in various embodiments. The ribbon sensor may be situated at a location 304 immediately preceding the print head. Alternatively, the ribbon sensor can be situated at a location following the print head 108 but preceding the trailing tension roller 302 (not shown). In some embodiments, a location following a print head may be less suitable because part of the functional layer of a printing ribbon is removed when printing; however, in some situations this may not be of concern, for example, when sensing a property of the printing ribbon before any of the printing ribbon is used, or when sensing a property of the printing ribbon that would not be affected by some of the printing ribbon having been used. In some embodiments, the ribbon sensor and the print head can be provided as an integrated component thereby situating the ribbon sensor at a location 304 immediately preceding the print head. One example of this configuration is shown with the ribbon sensor 200 as located in the exemplary embodiments of FIGS. 2A and 2C. As another example, a ribbon sensor can be provided together with a print head as an integrated component. As shown in FIG. 4, an integrated component 400 includes a print head 108 and a ribbon sensor 402. Such an integrated component can be used, for example, to retrofit prior printing devices with a ribbon sensor. Additionally, an integrated component such as shown in FIG. 4 allows for ideal positioning of a ribbon sensor in small printing devices, for example in which there might not be other space available for a ribbon sensor.

Further referring to FIGS. 3A and 3B, a ribbon sensor can be situated at a location 306 on the functional layer-side of the printing ribbon, between the leading tension roller 300 and a trailing tension roller 302. In some embodiments, space may be limited on the functional-layer side, particularly as along the media path 114 approaching the impingement of the printing ribbon with the media between the print head 108 and the platen roller 116. In another exemplary embodiment, a ribbon sensor can be situated between the ribbon supply spool 106/130 and the leading tension roller 300, either at a location 308/310 along the substrate-side or at a location 312/314 along the functional layer-side. A comparison of these locations as between FIGS. 3A and 3B illustrates that in some embodiments, there may exist a differing distance from the printing ribbon and the ribbon sensor as between an inwound spool 118 and an outwound spool 126, because of the differing tangential angles of the printing ribbon leading from the ribbon supply spool 106/130. This differing distance can be minimized at a location approaching the leading tension roller 300 in contrast with a location approaching the ribbon supply spool 106/130. In another exemplary embodiment, a ribbon sensor can be situated between the trailing tension roller 302 and the ribbon take-up spool 110, either at a location 316 along the substrate-side or at a location 318 along the functional layer-side. In another exemplary embodiment, a ribbon sensor can be situated at a location 320 along the surface of the ribbon supply spool 106/130 or at a location 322 along the surface of the ribbon take-up spool 110. Typically, a ribbon sensor will be located at about 1 mm to 10 mm away from the printing ribbon path. In some embodiments, the distance between a ribbon sensor and a printing ribbon can be 20 mm or closer, 15 mm or closer, 10 mm or closer, 5 m or closer, or 1 mm or closer.

Ribbon Sensors and Properties of Printing Ribbons

In general, a functional layer of a printing ribbon will have one or more properties which differ from that of the substrate of the printing ribbon. Given this, a ribbon sensor can be configured to sense one or more properties of a printing ribbon, and the values obtained from the ribbon sensor can be used to ascertain whether the functional layer or the substrate of the printing ribbon faces the ribbon sensor. Additionally, when a plurality of printing ribbons has one or more properties that differ as among the plurality, a ribbon sensor can be configured to sense one or more properties of a printing ribbon, and the values obtained from the ribbon sensor can be used to identify a printing ribbon from among the plurality.

In an exemplary embodiment, a thermal transfer printing ribbon may be provided. The functional layer of a thermal transfer printing ribbon typically includes a wax, a sensible material (e.g., a coloring agent, dye, pigment, or magnetic particles), and a resin binder. By contrast, the substrate of a thermal transfer printing ribbon is typically a thin film including a synthetic resin, such as polyethylene terephthalate (PET) polyester, and a protective silicone coating deposited on the outward surface of the substrate to reduce friction such as when passing the print head. Example waxes which can be used in a functional layer include paraffin wax, carnauba wax, and hydrocarbon wax. Example resins which can be used in a functional layer include thermoplastic resins and reactive resins such as epoxy resins. A sensible material can include a coloring agent, such as a dye or pigment, or magnetic particles. Example sensible materials include carbon black and various organic and inorganic pigments and dyes. Some functional layers include reactive dyes such as a leuco dye. Some functional layers include materials that allow encoding a printing media with a signal inducible ink, such as magnetic pigments or particles, charged pigments or particles, or emissive pigments or particles. Other printing ribbons for use in other printing modalities also typically include differing materials as between the functional layer and the substrate. A ribbon sensor can be configured to differentiate between a functional layer of a printing ribbon and a substrate of a printing ribbon based on one or more properties that differ as between the materials used in the functional layer and the substrate. Additionally or alternatively, a ribbon sensor can be configured to differentiate between different printing ribbons from among a plurality based on one or more properties that differ as between the materials used and their relative proportions as among the plurality.

In an exemplary embodiment, a ribbon sensor can be configured to sense an optical property of a printing ribbon. The optical property can be selected based on a difference as between the functional layer and the substrate of the printing ribbon. For example, a ribbon sensor can include a reflectance sensor configured to sense the reflectance of a printing ribbon. Additionally or alternatively, a ribbon sensor can be configured to sense any other optical property, including hue (or components thereof, such as L*a*b* values), lightness, brightness, luminance, emission (such as fluorescence), radiance, transmittance, attenuation, diffraction, refraction, scattering, absorbance, etc. In various other embodiments, a ribbon sensor can be configured to sense any other property of a printing ribbon which may differ as between the functional layer and the substrate of the printing ribbon, or as among a plurality of different printing ribbons, such as an electric property (e.g., electric charge, etc.) or a magnetic property (e.g., magnetic moment, diamagnetism, etc.).

Sensors for measuring various optical or other properties are well known to those skilled in the art and therefore will not be discussed in detail. As a general example, a reflectance sensor typically includes an LED light source such as an infrared LED paired with a photodiode or a phototransistor. A ribbon sensor that includes a reflectance sensor can be configured to obtain a signal corresponding to reflection of light from the printing ribbon and incident upon the phototransistor. The signal can be used to ascertain a reflectance value for the surface of the ribbon facing the reflectance sensor, and because typically a substrate and a functional layer of a printing ribbon will exhibit markedly different reflectance values, the values obtained from such as reflectance sensor can be used to ascertain whether the substrate or the functional layer of a printing ribbon faces the ribbon sensor. Similarly, a plurality of printing ribbons can be differentiated from one another using a reflectance sensor to ascertain a reflectance value of a printing ribbon form among the plurality.

Given the materials typically used in a thermal transfer printing ribbon such as those discussed above, the functional layer of a thermal transfer printing ribbon will typically exhibit a substantially diffuse reflectance and the substrate of a thermal transfer printing ribbon will typically exhibit a substantially specular reflectance. In other words, typically a functional layer of a thermal transfer printing ribbon will have a matte appearance and typically a substrate of a thermal transfer printing ribbon will have a gloss appearance. Similarly, printing ribbons for other printing modalities also typically have a functional layer that exhibits a substantially diffuse reflectance and a substrate that exhibits a substantially specular reflectance.

In an exemplary embodiment, a reflectance value above a threshold can be characterized as being substantially specular and a reflectance value below the threshold as being substantially diffuse. Similarly, in another exemplary embodiment a substantially specular range can be appropriately defined with reflectance values within the range being substantially specular. Likewise, a substantially diffuse range can be appropriately defined with reflectance values within the range being substantially diffuse. As examples, in some embodiments, a functional layer of a printing ribbon can exhibit a substantially diffuse reflectance of at least less than 50% and a substrate of a printing ribbon exhibit a substantially specular reflectance of at least greater than 50%. Accordingly, a threshold can be defined at 50%, with reflectance values above the threshold being substantially specular and/or reflectance values below the threshold being substantially diffuse. In other embodiments, as examples, a functional layer of a printing ribbon can exhibit a substantially diffuse reflectance of less than 45%, less than 35%, less than 25%, less than 15%, less than 10%, less than 5%, or less than 1%; and a functional layer of a printing ribbon can exhibit a substantially diffuse reflectance of at least 55%, at least 65%, at least 75%, at least 85%, at least 90%, at least 95%, or at least 99%. Accordingly, as examples, a threshold can be defined at 45%, 35%, 25%, 15%, 10%, 5%, or 1%, with reflectance values below the threshold being substantially diffuse; and/or a threshold can be defined at 55%, 65%, 75%, 85%, 90%, 95%, or 99%, with reflectance values above the threshold being substantially specular.

In another exemplary embodiment, as examples, a functional layer of a printing ribbon can exhibit a substantially diffuse reflectance in a range between 55% and 45%, between 45% and 35%, between 35% and 25%, between 25% and 15%, between 15% and 5%, between 10% and 1%, or between 5% and 1%; and/or a functional layer of a printing ribbon can exhibit a substantially diffuse reflectance in a range between 45% and 55%, between 55% and 65%, between 65% and 75%, between 75% and 85%, between 85% and 95%, between 90% and 99%, or between 95% and 99%. Accordingly, as examples, a range can be defined between 55% and 45%, between 45% and 35%, between 35% and 25%, between 25% and 15%, between 15% and 5%, between 10% and 1%, or between 5% and 1%, with reflectance values within the range being substantially diffuse; and/or a range can be defined between 45% and 55%, between 55% and 65%, between 65% and 75%, between 75% and 85%, between 85% and 95%, between 90% and 99%, or between 95% and 99%, with reflectance values within the range being substantially specular. Similar thresholds or ranges can be provided for any one or more other properties of a printing ribbon, including other optical properties, electric properties, or magnetic properties.

In another exemplary embodiment, as examples, a reflectance as expected from a substrate of a printing ribbon may differ from a reflectance as expected from a functional layer of a printing ribbon by 1% or more, by 5% or more, by 10% or more, by 20% or more, by 30% or more, by 40%, or more, by 50% or more, by 60% or more, by 70% or more, by 80% or more, or by 90% or more. Some printing ribbons may exhibit different reflectance characteristics, however, and those skilled in the art will appreciate that appropriately defined values, thresholds, or ranges can be selected depending on the specific embodiment which those skilled in the art might select from the spirit and scope of the present disclosure.

Figure 5A:
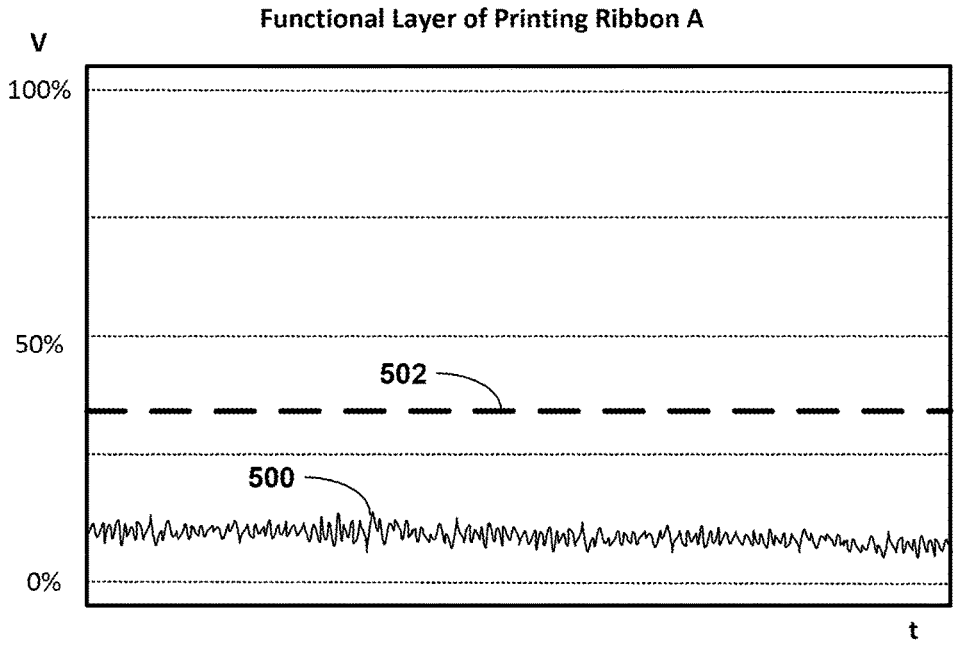
FIGS. 5A through 5F graphically depict exemplary optical values corresponding to respective functional layers and substrates of exemplary printing ribbons.
Figure 5B:
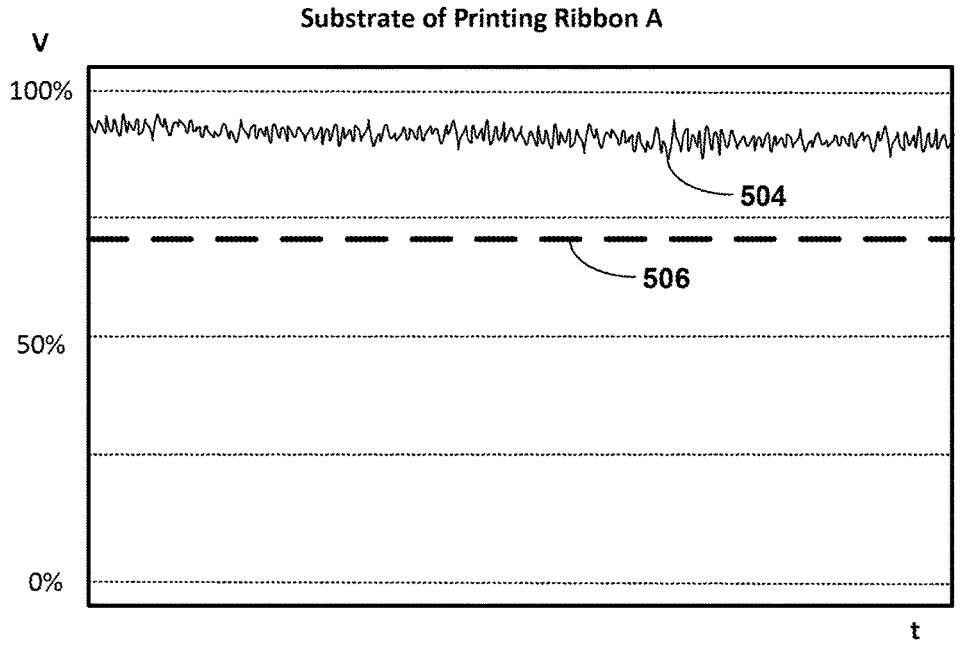

As further examples, FIGS. 5A through 5F show exemplary optical values corresponding to functional layers and substrates of exemplary printing ribbons. For example, the optical values shown in FIGS. 5A through 5F can be reflectance values; however, these examples are also intended to be illustrative of examples applicable to other properties. Accordingly, in an exemplary embodiment, FIGS. 5A and 5B respectively show exemplary optical values for a functional layer and a substrate of an exemplary printing ribbon. FIG. 5A shows an optical value 500 for a functional layer of an exemplary printing ribbon. The optical value 500 is below a threshold 502. In an exemplary embodiment, the optical value 500 is a reflectance value, and as being below the threshold 502 can be characterized as a reflectance value corresponding to a substantially diffuse reflectance. FIG. 5B shows an optical value 504 for a substrate of an exemplary printing ribbon. The optical value 504 is above a threshold 506. In an exemplary embodiment, the optical value 504 is a reflectance value, and as being above the threshold 506 can be characterized as a reflectance value corresponding to a substantially specular reflectance.

Figure 5C:
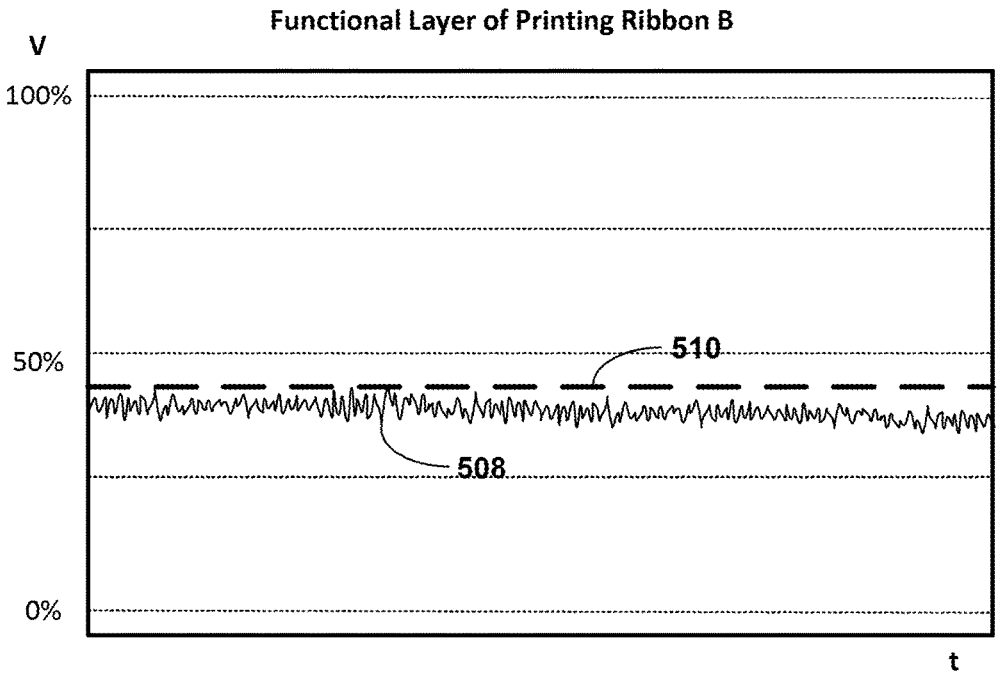
Figure 5D:
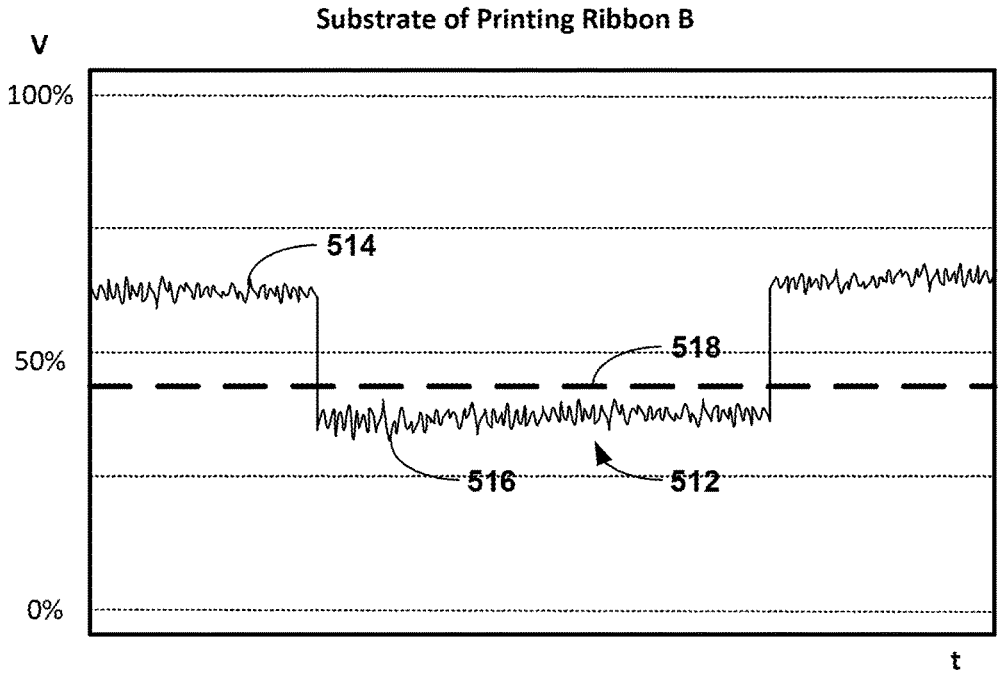

FIGS. 5C and 5D respectively show exemplary optical values, which for example can be reflectance values, for a functional layer and a substrate of another exemplary printing ribbon. As shown in FIG. 5C, an optical value 508 is below a threshold 510. In an exemplary embodiment, the optical value 508 is a reflectance value, and the reflectance value can be characterized as corresponding to a substantially diffuse reflectance. By comparison, the optical value 508 might exceed the threshold 502 shown in FIG. 5A; however, the exemplary embodiment of FIG. 5C provides a different threshold 510, which comparison illustrates that those skilled in the art can select various thresholds as appropriate for the printing ribbon or plurality of printing ribbons of interest. FIG. 5D shows an optical value 512 for the substrate of the printing ribbon corresponding to the functional layer shown in FIG. 5C. As illustrated by the optical value 512, a value can vary, for example, as between a high value 514 and a low value 516. In some embodiments, a varying optical value may reflect a difference in properties as the printing ribbon moves past the ribbon sensor. For example, some substrates may contain information such as indicator marks, text, graphs, or the like, which may exhibit a different optical value than that of the native substrate material.

In some embodiments, a varying optical value may be indicative of a substrate, particularly where a functional layer would not be expected to exhibit such a varying optical value. However, in some embodiments a functional layer may also exhibit a varying optical value. For example, a dye sublimation printing ribbon may alternate between colors along the length of the ribbon. As another example, some printing ribbons may have an alternating series of transfer segments of a coloring agent or ink separated by gaps, which can yield a varying optical value as between the gaps and the transfer segments. As shown in FIG. 5D, the optical value 512 is at times above a threshold 518 and at times below the threshold 518. In some embodiments, an optical value can be characterized as being below a threshold when the optical value is sometimes below the threshold and/or an optical value can be characterized as being above a threshold when the optical value is sometimes above the threshold. For example, when the optical value 512 is a reflectance value, in some embodiments the reflectance value can be characterized as corresponding to a substantially specular reflectance based on the high value 514 being above the threshold 518. This may occur, for example, when surface markings on a substrate have a more diffuse reflectance than the reflectance of the native substrate.

Figure 5E:
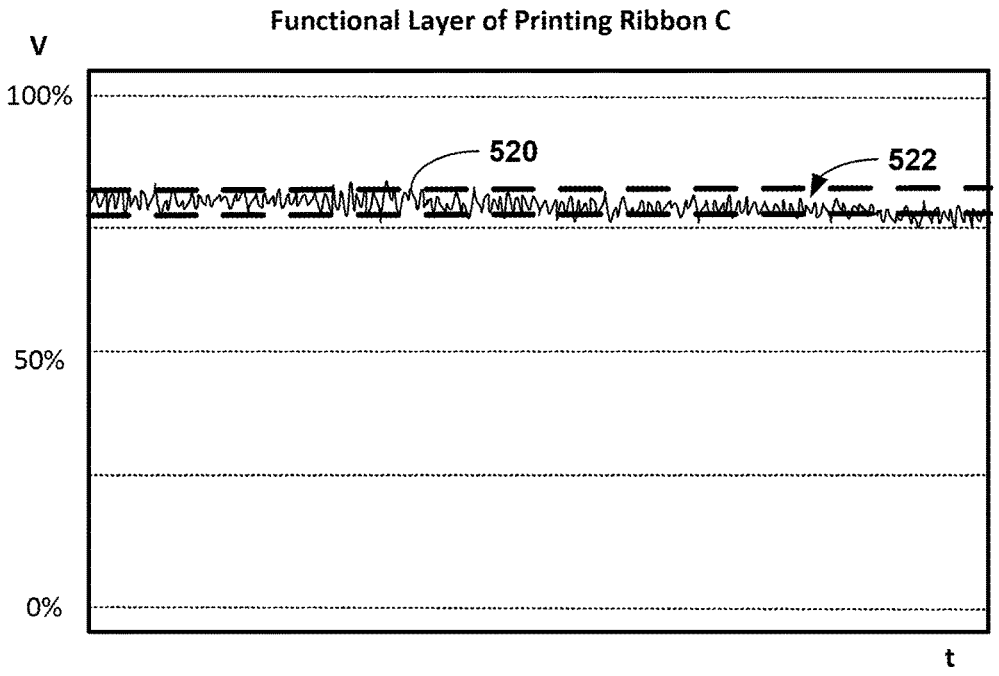
Figure 5F:
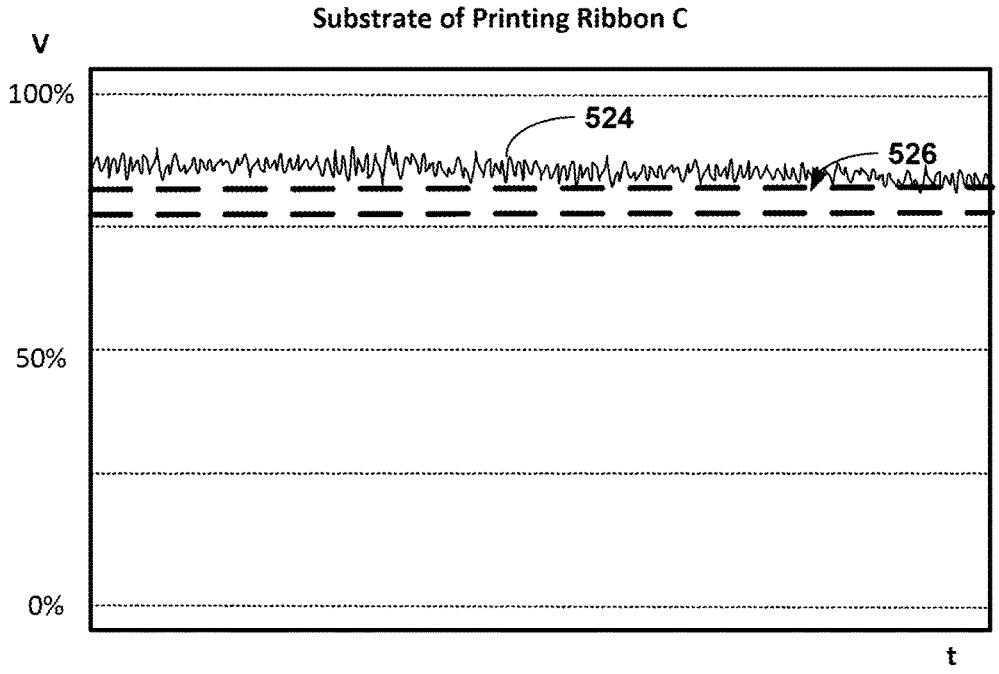

FIGS. 5E and 5F respectively show exemplary optical values for a functional layer and a substrate of yet another exemplary printing ribbon. FIG. 5E shows an optical value 520 such as a reflectance value for a functional layer of an exemplary printing ribbon. The optical value 520 is within a range 522. In an exemplary embodiment, the optical value 520 is a reflectance value, and as being within the range 522 can be characterized as a reflectance value corresponding to a substantially diffuse reflectance. In some embodiments, a printer or printing system can be configured to ascertain that a given surface of a printing ribbon faces a ribbon sensor only when the optical values fall within a range. For example, a printer or printing system may be configured to ascertain that the optical value 520 corresponds to the functional layer of a printing ribbon only when the optical value falls within the range 522. This may be appropriate where a reflectance value or other optical value corresponding to the functional layer of a printing ribbon or plurality of printing ribbons happens to be known within a certain range. In some embodiments, even a reflectance value indicating a more diffuse reflectance value outside the range 522 might be characterized as corresponding to the substrate of the printing ribbon rather than to the functional layer. Here, a more diffuse reflectance value may correspond to surface markings on a substrate or some other distinguishing feature. FIG. 5F shows an optical value 524 such as a reflectance value for a substrate of an exemplary printing ribbon. The optical value 524 is outside a range 526. In some embodiments, the range 526 may be the same as the range 522 shown in FIG. 5E. In an exemplary embodiment, the optical value 524 is a reflectance value, and as being outside the range 526 can be characterized as a reflectance value corresponding to a substantially specular reflectance.

In some embodiments, one or more optical properties or other properties of a printing ribbon can be compared against a combination of defined values, threshold values, and/or ranges. For example, a value obtained from a ribbon sensor can be characterized as corresponding to a substrate of a printing ribbon based on the relation of the value to a threshold, and/or as corresponding to a functional layer of the printing ribbon based on the relation of the value to a range, and vice versa. As another example, a value obtained from a ribbon sensor can be characterized as corresponding to a substrate and/or as corresponding to a functional layer of a printing ribbon, based on a relation of the value to both a threshold and a range. In some embodiments, one or more optical properties or other properties of a printing ribbon can be compared against a defined value, in addition or as an alternative to a threshold value or a range. For example, a defined value can be a known value corresponding to a functional layer of a printing ribbon or a known value corresponding to a substrate of a printing ribbon.

In some embodiments, a printer or printing system may utilize a plurality of different printing ribbons, and the printer or printing system can be configured to identify a printing ribbon from among the plurality based on a value obtained from a ribbon sensor. For example, the functional layer and/or the substrate of various printing ribbons may exhibit different values, thereby allowing a printer or printing system to identify a printing ribbon based on the value. Similarly, in some embodiments a printing ribbon can be identified from among a plurality of printing ribbons based on comparison of a value obtained from a ribbon sensor to a threshold value or a range. In some embodiments, a printer or printing system may use a plurality of printing ribbons, each providing a different coloring agent or ink which may be applied to the media during printing. For example, the plurality of printing ribbons may include different colors. Additionally or alternatively, the plurality of printing ribbons may include ribbons with and without certain functional materials, such as reactive dyes, and/or materials that allow encoding a printing media with a signal inducible ink, such as magnetic pigments or particles, charged pigments or particles, or emissive pigments or particles. A ribbon sensor may be configured to distinguish between such different printing ribbons based on a comparison of a value obtained from the ribbon sensor to a defined value, threshold value, or range.

Printing Ribbon Installation, Detecting Printing Ribbon Orientation, and Responsive Actions Exemplary methods and features of printing devices and printing systems include methods and features configured for ascertaining an orientation of a printing ribbon, for triggering a response in the event of an improperly oriented printing ribbon, and/or confirming proper orientation of a printing ribbon. Exemplary methods and features of printing devices and printing systems additionally or alternatively include methods and features configured for properly installing a printing ribbon.

Figure 6:
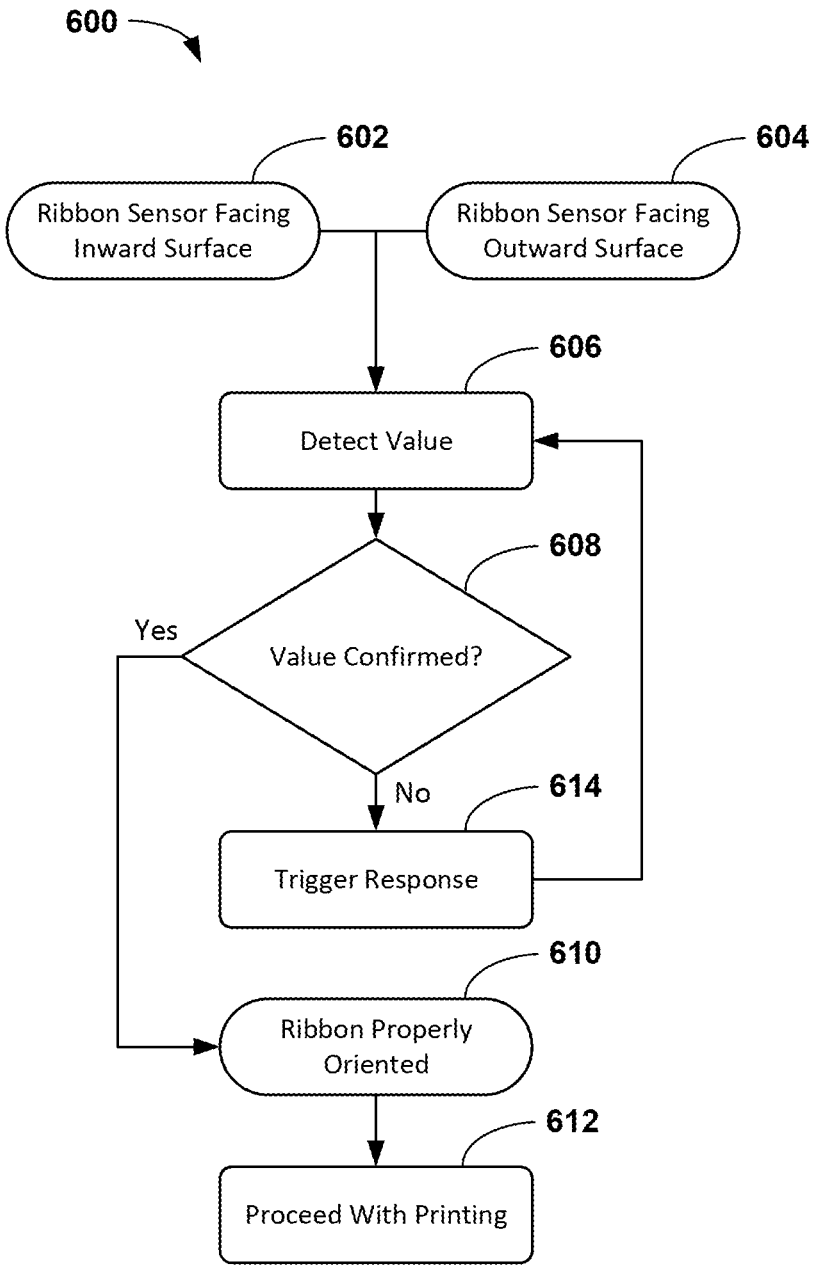
FIG. 6 shows a flow chart depicting exemplary steps and/or features configured, among other things, to ascertain an orientation of a printing ribbon.

FIG. 6 shows a flow chart depicting exemplary steps 600 and/or features which can be configured, for example, to ascertain an orientation of a printing ribbon, to provide proper installation of a printing ribbon, to trigger a response in the event of an improperly installed printing ribbon, to confirm proper installation of a printing ribbon, and/or to identify a printing ribbon from among a plurality of printing ribbons. The exemplary steps shown in FIG. 6A can be implemented with a ribbon sensor facing the inward surface (i.e., the substrate-side of a properly oriented printing ribbon) 602, and/or with a ribbon sensor facing the outward surface (i.e., the functional layer-side of a properly oriented printing ribbon) 604. With a printing ribbon at least partially installed in a printer or printing system, the ribbon sensor detects a value 606 corresponding to a property of the printing ribbon. The property can be any property whereby a functional layer of a printing ribbon can be distinguished from a substrate of the printing ribbon, including an optical property, an electrical property, or a magnetic property as discussed herein. The property can additionally or alternatively be any property whereby a printing ribbon can be identified from among a plurality of printing ribbons.

The value of the property is compared against one or more criteria 608 to confirm whether the value corresponds to the one or more criteria. As examples, the criteria can be a defined value, a range, and/or a threshold. For example, a substrate of a printing ribbon or a plurality of printing ribbons of interest may have a property which corresponds to a defined value, a range, or a threshold. A ribbon sensor can be configured to detect the value. The ribbon sensor can detect the value, for example, before starting printing. In some embodiments, a ribbon sensor can be configured to detect the value upon the occurrence of a triggering event. For example, a printing device may have a panel or door used to access and replenish a printing ribbon, and closing the panel or door may trigger a switch thereby prompting the ribbon sensor to detect the value. Additionally or alternatively, the value of the property can be compared against one or more criteria 608 to identify or to confirm the identity of a printing ribbon from among a plurality of printing ribbons.

When a ribbon sensor faces the inward surface of a properly oriented printing ribbon 602, a value can be confirmed when the value corresponds to the applicably selected defined value, threshold, or range, for the substrate of the printing ribbon or plurality of printing ribbons of interest. Conversely, when the ribbon sensor faces the outward surface of a properly oriented printing ribbon 604, a value can be confirmed when the value corresponds to the applicably selected defined value, threshold, or range, for the functional layer of the printing ribbon or plurality of printing ribbons of interest. In some embodiments, a value detected by the ribbon sensor will not be confirmed when the value does not correspond to the applicably selected defined value, threshold, or range. This may occur, for example, when a ribbon sensor obtains a value known to correspond to an improperly oriented printing ribbon, and/or when a ribbon sensor obtains a value from which it remains undetermined whether the printing ribbon is properly oriented. In some embodiments, a value is confirmed 608 when the printing ribbon is properly oriented 610, and a value is not confirmed when the printing ribbon is improperly oriented and/or when it remains undetermined whether the printing ribbon is improperly oriented.

With the printing ribbon properly oriented 610, the printing device or printing system proceeds with printing 612. Conversely, when the value is not confirmed, a conclusion cannot be made that the printing ribbon is properly oriented, and accordingly in some embodiments a response can be triggered 614. The response can include an alarm, such as a visual or audible alarm, and/or an error message provided to a user such as through a user interface on a printing device or through a network configured to remotely alert a user. Additionally, the response may include issuing a stop print command to prevent further printing, re-routing print jobs to a different printing device or printing system, and/or requesting a standby printer.

Figure 7A:
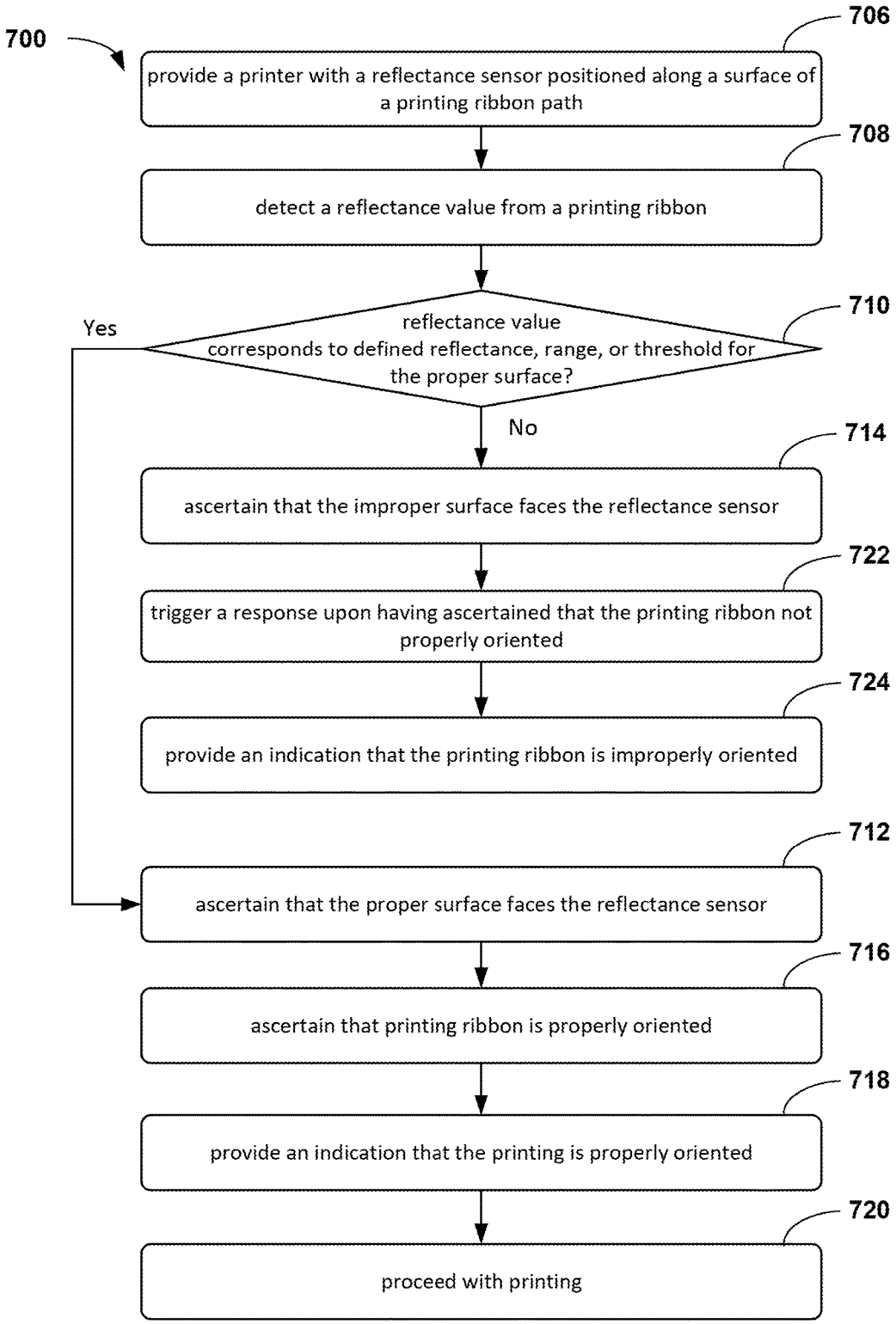
FIGS. 7A through 7C show flow charts depicting additional exemplary steps and/or features configured, among other things, to ascertain an orientation of a printing ribbon.
Figure 7B:
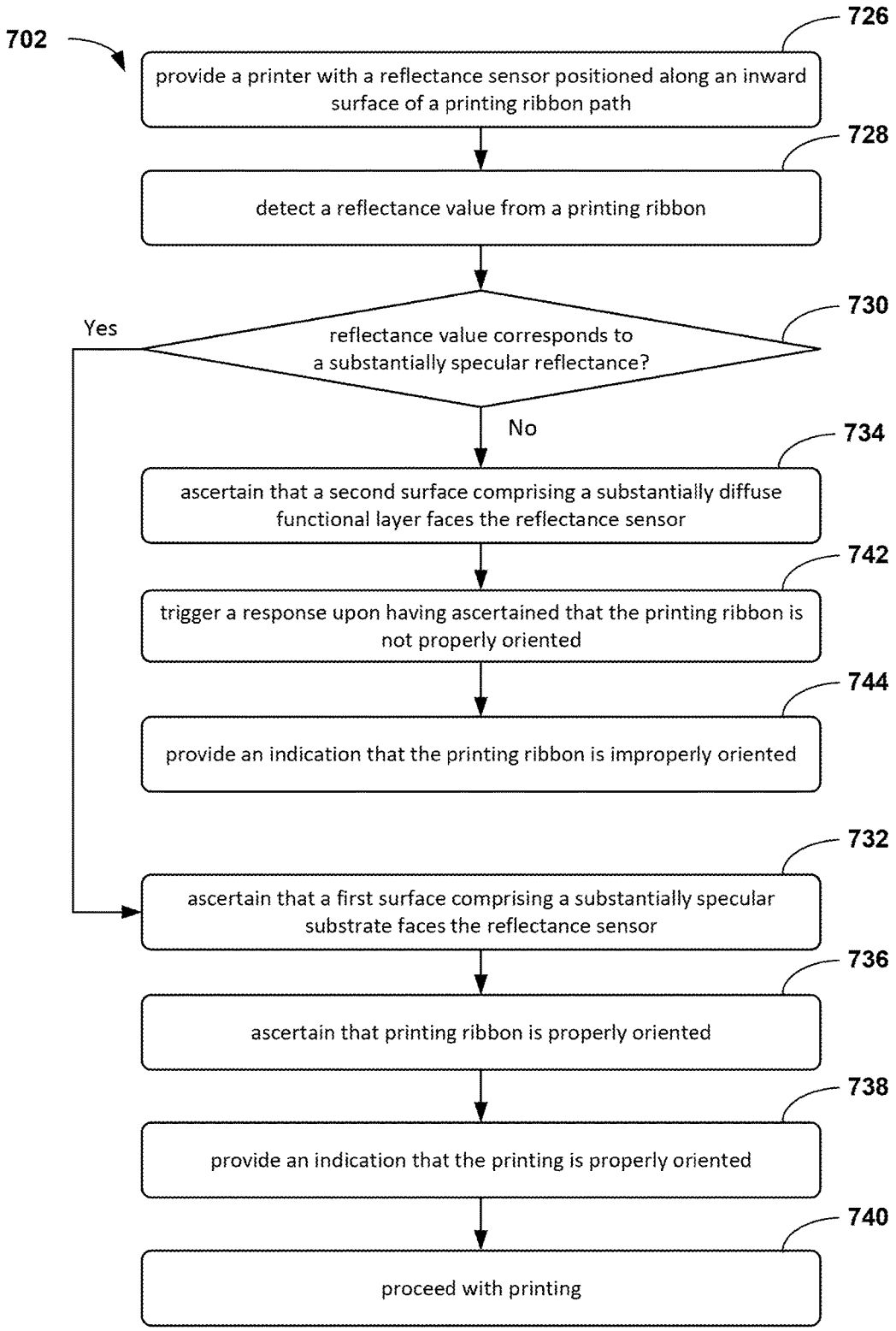
Figure 7C:
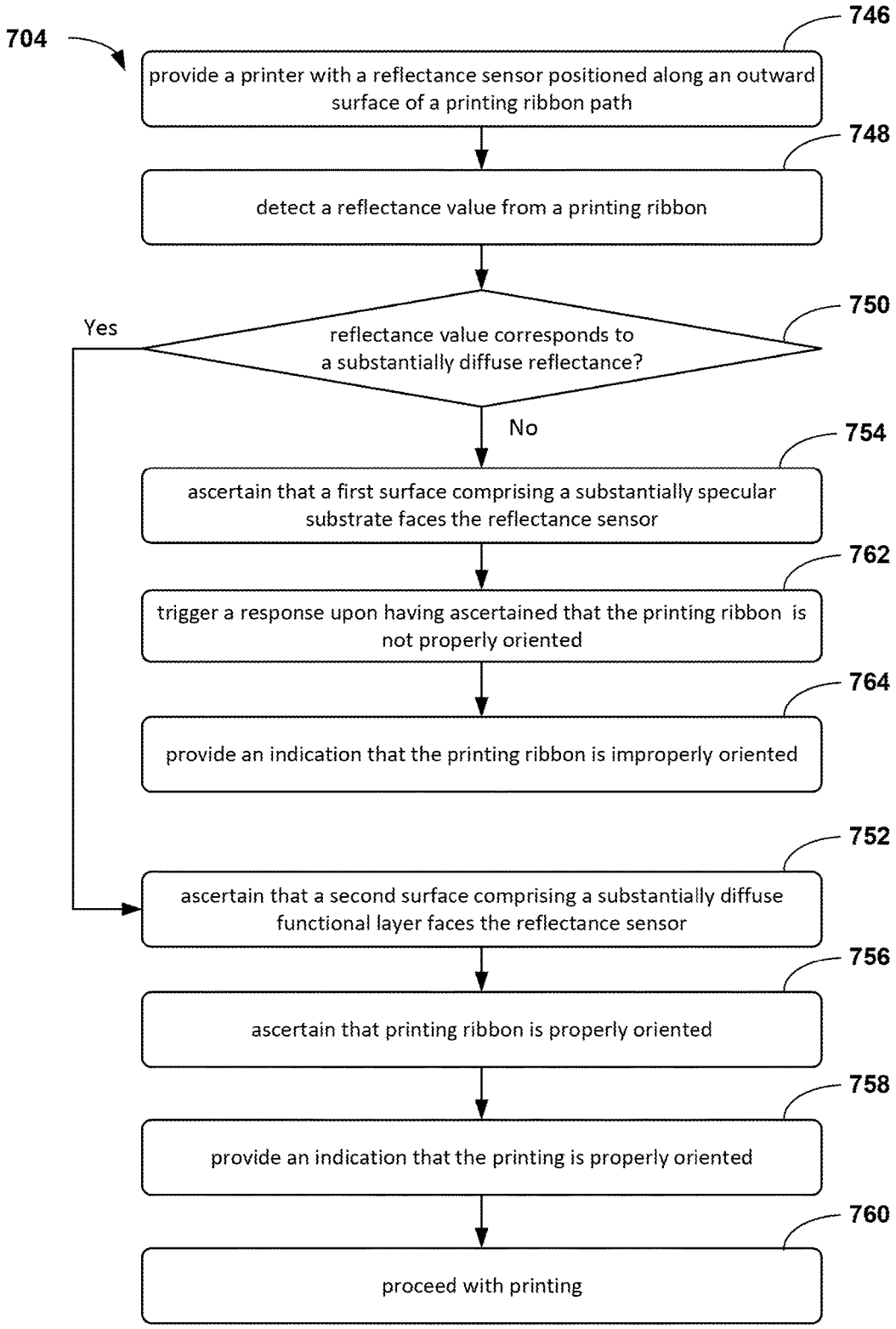

FIGS. 7A through 7C show flow charts depicting additional exemplary embodiments of steps and/or features configured to ascertain an orientation of a printing ribbon, to provide proper installation of a printing ribbon, to trigger a response in the event of an improperly installed printing ribbon and/or to confirm proper installation of a printing ribbon. In an exemplary embodiment, the steps shown in FIGS. 7A-7C utilize a ribbon sensor that includes a reflectance sensor configured to sense a reflectance of a printing ribbon and return a reflectance value. In other exemplary embodiments, the steps shown in FIGS. 7A-7C can be implemented with a ribbon sensor configured to sense any other property that can be used to distinguish a functional layer of a printing ribbon from a substrate.

With reference to FIG. 7A, exemplary steps or features 700 can be configured to provide a printer or printing system with a reflectance sensor positioned along a surface of a printing ribbon path 706, and to detect a reflectance value from a printing ribbon 708. Exemplary steps or features can be configured to ascertain whether the reflectance value corresponds to a defined reflectance value, range, or threshold for the proper surface of a printing ribbon when the printing ribbon is properly oriented 710, and in turn, to ascertain that the proper surface faces the reflectance sensor 712 when the reflectance value corresponds to the defined reflectance value, range, or threshold and/or to ascertain that the improper surface faces the reflectance sensor 714 when the reflectance value does not corresponds to the defined reflectance value, range, or threshold for the proper surface. Upon having ascertained that the proper surface of the printing ribbon faces the reflectance sensor 712, exemplary steps and/or features can be configured to ascertain that the printing ribbon is properly oriented 716, which may include providing an indication that the printing ribbon is properly oriented 718. A printing device or printing system can be configured to proceed with printing 720 upon having ascertained that the proper surface of the printing ribbon faces the reflectance sensor. Conversely, upon having ascertained that the printing ribbon is not properly oriented 722, exemplary steps and/or features can be configured to trigger a response which may include providing an indication that the printing ribbon is not properly oriented 724. The response or indication may include an alarm, such as a visual or audible alarm, and/or an error message provided to a user such as on a user interface or through a network configured to remotely alert a user. Additionally, the response may include issuing a stop print command to prevent further printing, re-routing print jobs to a different printing device or printing system, and/or requesting a standby printer.

In another exemplary embodiment shown in FIG. 7B, steps or features 702 can be configured to provide a printer or printing system with a reflectance sensor positioned along an inward surface of a printing ribbon path 726 and to detect a reflectance value from a printing ribbon 728. Exemplary steps or features can be configured to ascertain whether the reflectance value corresponds to a substantially specular reflectance 730, and in turn, to ascertain that a first surface of a printing ribbon comprising a substantially specular substrate faces the reflectance sensor 732 when the reflectance value corresponds to a substantially specular reflectance and/or to ascertain that a second surface comprising a substantially diffuse functional layer faces the reflectance sensor 734 when the reflectance value does not corresponds to a substantially specular reflectance. The reflectance value can be compared to a defined reflectance value, range, or threshold for a substrate of a printing ribbon or for respective substrates of a plurality of printing ribbons of interest. Upon having ascertained that the substrate of the printing ribbon faces the reflectance sensor 732, exemplary steps and/or features can be configured to ascertain that the printing ribbon is properly oriented 736, which may include an indication that the printing ribbon is properly oriented 738. A printing device or printing system can be configured to proceed with printing 740 upon having ascertained that the printing ribbon is properly oriented such that the substrate of the printing ribbon faces the reflectance sensor. Conversely, upon having ascertained that the printing ribbon is not properly oriented 742, exemplary steps and/or features can be configured to trigger a response which may include providing an indication that the printing ribbon is not properly oriented 744. The response or indication may include an alarm, such as a visual or audible alarm, and/or an error message provided to a user such as on a user interface or through a network configured to remotely alert a user. Additionally, the response may include issuing a stop print command to prevent further printing, re-routing print jobs to a different printing device or printing system, and/or requesting a standby printer.

In yet another exemplary embodiment shown in FIG. 7C, steps or features 704 can be configured to provide a printer or printing system with a reflectance sensor positioned along an outward surface of a printing ribbon path 746 and to detect a reflectance value from a printing ribbon 748. Exemplary steps or features can be configured to ascertain whether the reflectance value corresponds to a substantially diffuse reflectance 750, and in turn, to ascertain that a second surface of a printing ribbon comprising a substantially diffuse functional layer faces the reflectance sensor 752 when the reflectance value corresponds to a substantially diffuse reflectance and/or to ascertain that a first surface comprising a substantially specular substrate faces the reflectance sensor 754 when the reflectance value does not corresponds to a substantially diffuse reflectance. The reflectance value can be compared to a defined reflectance value, range, or threshold for a functional layer of a printing ribbon or for respective functional layers of a selection of printing ribbons of interest. Upon having ascertained that the functional layer of the printing ribbon faces the reflectance sensor 752, exemplary steps and/or features can be configured to ascertain that the printing ribbon is properly oriented 756, which may include providing an indication that the printing ribbon is properly oriented 758. A printing device or printing system can be configured to proceed with printing 760 upon having ascertained that the printing ribbon is properly oriented such that the functional layer of the printing ribbon faces the reflectance sensor. Conversely, upon having ascertained that the printing ribbon is not properly oriented 762, exemplary steps and/or features can be configured to trigger a response which may include providing an indication that the printing ribbon is not properly oriented 764. The response or indication may include an alarm, such as a visual or audible alarm, and/or an error message provided to a user such as on a user interface or through a network configured to remotely alert a user. Additionally, the response may include issuing a stop print command to prevent further printing, re-routing print jobs to a different printing device or printing system, and/or requesting a standby printer.

Figure 8:
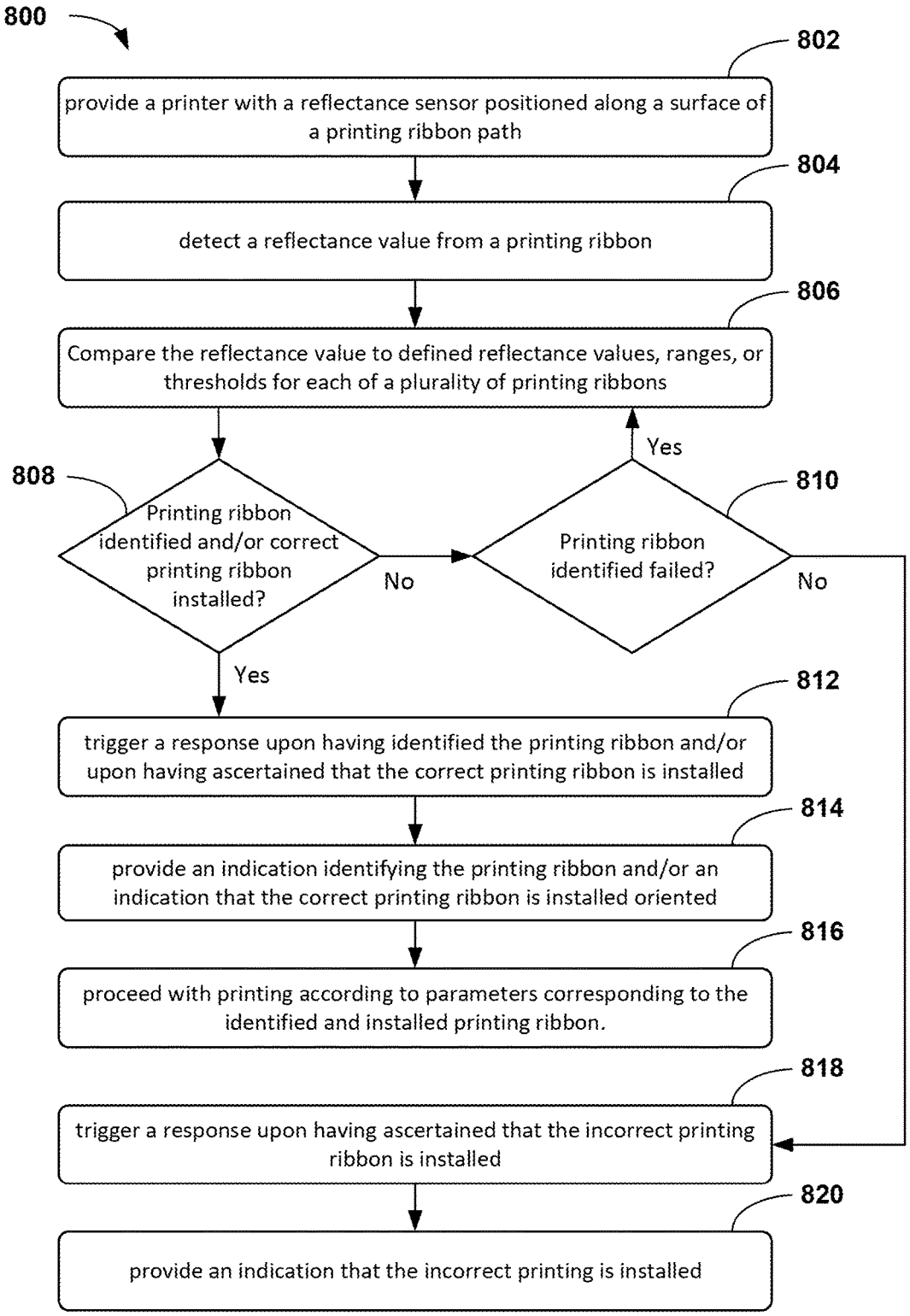
FIG. 8 shows a flow chart depicting exemplary steps and/or features configured, among other things, to identify a printing ribbon from among a plurality of printing ribbons.

FIG. 8 shows flow charts depicting an exemplary embodiment of steps and/or features configured to identify a printing ribbon from among a plurality of printing ribbons, and to ascertain whether the correct printing ribbon has been installed in the printer. In an exemplary embodiment, the steps shown in FIG. 8 utilize a ribbon sensor that includes a reflectance sensor configured to sense the reflectance of a printing ribbon and return a reflectance value. In other exemplary embodiments, the steps shown in FIG. 8 can be implemented with a ribbon sensor configured to sense any other property that can be used to identify a printing ribbon from among a plurality of printing ribbons. Exemplary steps or features 800 can be configured to provide a printer or printing system with a reflectance sensor positioned along a surface of a printing ribbon path 802, and to detect a reflectance value from a printing ribbon 804, and to compare the reflectance value to a defined reflectance value, range, or threshold for each of a plurality of printing ribbons 806 to identify the printing ribbon from among the plurality. Following the comparison, exemplary steps or features can be configured to ascertain whether the printing ribbon has been identified 808, and/or to ascertain whether the correct printing ribbon has been installed in the printer or printing system 810. A response may be triggered 812 upon having identified the printing ribbon and/or upon having ascertained that the correct printing ribbon is installed. The response can include providing an indication identifying the printing ribbon and/or an indication that the correct printing ribbon is installed oriented 814. Additionally or alternatively, the response may include executing instructions operable to cause the printer or printing system to proceed with printing according to one or more parameters corresponding to the identified and installed printing ribbon 816. The one or more parameters may include print commands, or settings for a print head or other configurable settings of a printer or printing system. For example, the printer or printing system may be configured with different settings depending on the printing ribbon installed. A different response may be triggered upon having ascertained that the incorrect printing ribbon is installed 818, which may include providing an indication that he incorrect printing ribbon is installed 820. The response or indication may include an alarm, such as a visual or audible alarm, and/or an error message provided to a user such as on a user interface or through a network configured to remotely alert a user. Additionally, the response may include issuing a stop print command to prevent further printing, re-routing print jobs to a different printing device or printing system, and/or requesting a standby printer.

Figure 9:
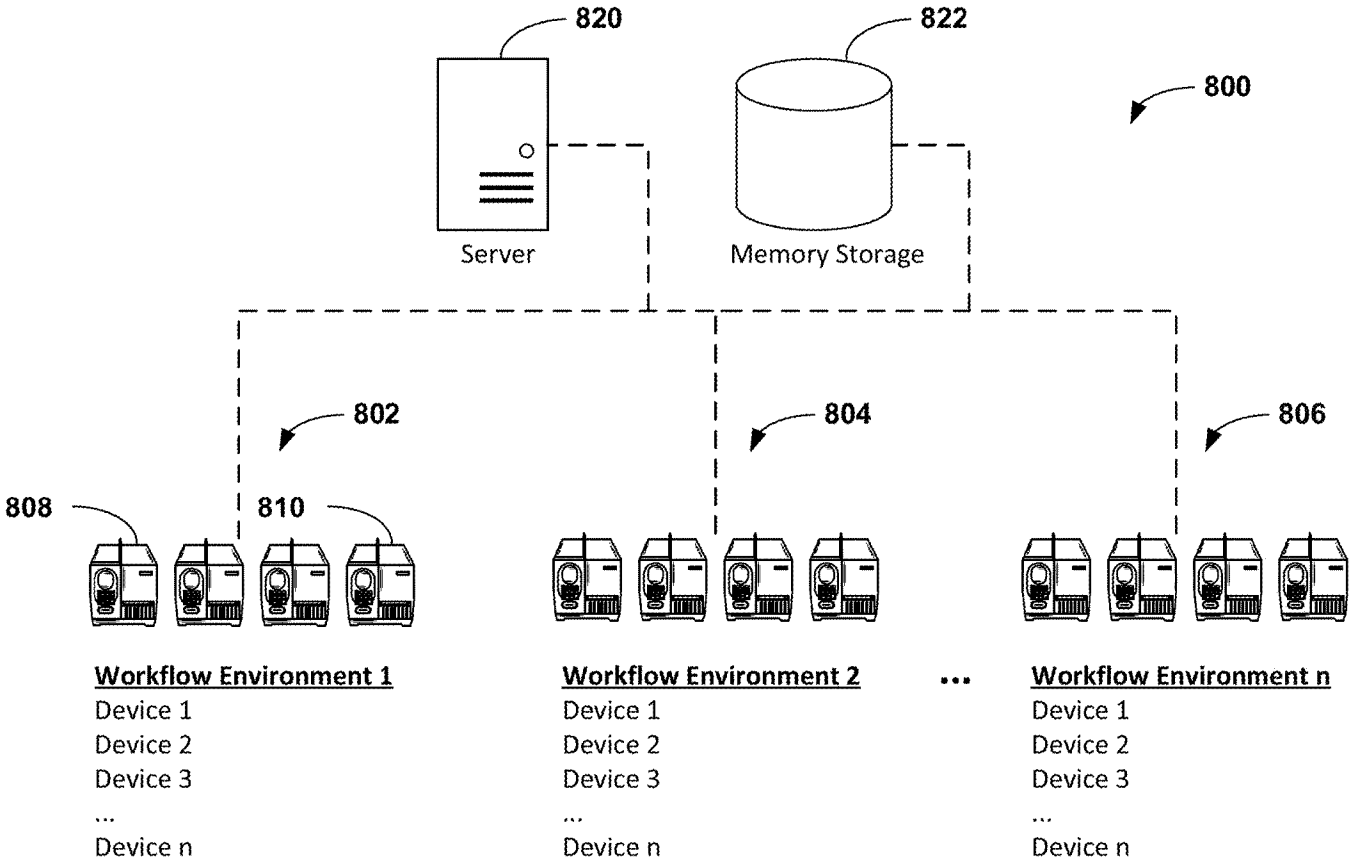
FIG. 9 schematically depicts an exemplary network environment for implementing the devices, systems, and methods disclosed herein.

FIG. 9 schematically depicts an exemplary network environment 800 within which the devices, systems, and methods disclosed herein can be implemented. In some embodiments, a network environment can include a plurality of workflow environments 802, 804, 806, each of which including one or more printers or other printing devices 808, 810. A server 820 and a memory storage 822 can be provided for managing the network environment 800, which may include managing the devices, systems, and methods disclosed herein at an enterprise level, the workflow environment level, and/or at the device level.

To supplement the present disclosure, this application incorporates entirely by reference the following commonly assigned patents, patent application publications, and patent applications:

U.S. Pat. No. 6,832,725; U.S. Pat. No. 7,128,266; U.S. Pat. No. 7,159,783; U.S. Pat. No. 7,413,127; U.S. Pat. No. 7,726,575; U.S. Pat. No. 8,294,969; U.S. Pat. No. 8,317,105; U.S. Pat. No. 8,322,622; U.S. Pat. No. 8,366,005; U.S. Pat. No. 8,371,507; U.S. Pat. No. 8,376,233; U.S. Pat. No. 8,381,979; U.S. Pat. No. 8,390,909; U.S. Pat. No. 8,408,464; U.S. Pat. No. 8,408,468; U.S. Pat. No. 8,408,469; U.S. Pat. No. 8,424,768; U.S. Pat. No. 8,448,863; U.S. Pat. No. 8,457,013; U.S. Pat. No. 8,459,557; U.S. Pat. No. 8,469,272; U.S. Pat. No. 8,474,712; U.S. Pat. No. 8,479,992; U.S. Pat. No. 8,490,877; U.S. Pat. No. 8,517,271; U.S. Pat. No. 8,523,076; U.S. Pat. No. 8,528,818; U.S. Pat. No. 8,544,737; U.S. Pat. No. 8,548,242; U.S. Pat. No. 8,548,420; U.S. Pat. No. 8,550,335; U.S. Pat. No. 8,550,354; U.S. Pat. No. 8,550,357; U.S. Pat. No. 8,556,174; U.S. Pat. No. 8,556,176; U.S. Pat. No. 8,556,177; U.S. Pat. No. 8,559,767; U.S. Pat. No. 8,599,957; U.S. Pat. No. 8,561,895; U.S. Pat. No. 8,561,903; U.S. Pat. No. 8,561,905; U.S. Pat. No. 8,565,107; U.S. Pat. No. 8,571,307; U.S. Pat. No. 8,579,200; U.S. Pat. No. 8,583,924; U.S. Pat. No. 8,584,945; U.S. Pat. No. 8,587,595; U.S. Pat. No. 8,587,697; U.S. Pat. No. 8,588,869; U.S. Pat. No. 8,590,789; U.S. Pat. No. 8,596,539; U.S. Pat. No. 8,596,542; U.S. Pat. No. 8,596,543; U.S. Pat. No. 8,599,271; U.S. Pat. No. 8,599,957; U.S. Pat. No. 8,600,158; U.S. Pat. No. 8,600,167; U.S. Pat. No. 8,602,309; U.S. Pat. No. 8,608,053; U.S. Pat. No. 8,608,071; U.S. Pat. No. 8,611,309; U.S. Pat. No. 8,615,487; U.S. Pat. No. 8,616,454; U.S. Pat. No. 8,621,123; U.S. Pat. No. 8,622,303; U.S. Pat. No. 8,628,013; U.S. Pat. No. 8,628,015; U.S. Pat. No. 8,628,016; U.S. Pat. No. 8,629,926; U.S. Pat. No. 8,630,491; U.S. Pat. No. 8,635,309; U.S. Pat. No. 8,636,200; U.S. Pat. No. 8,636,212; U.S. Pat. No. 8,636,215; U.S. Pat. No. 8,636,224; U.S. Pat. No. 8,638,806; U.S. Pat. No. 8,640,958; U.S. Pat. No. 8,640,960; U.S. Pat. No. 8,643,717; U.S. Pat. No. 8,646,692; U.S. Pat. No. 8,646,694; U.S. Pat. No. 8,657,200; U.S. Pat. No. 8,659,397; U.S. Pat. No. 8,668,149; U.S. Pat. No. 8,678,285; U.S. Pat. No. 8,678,286; U.S. Pat. No. 8,682,077; U.S. Pat. No. 8,687,282; U.S. Pat. No. 8,692,927; U.S. Pat. No. 8,695,880; U.S. Pat. No. 8,698,949; U.S. Pat. No. 8,717,494; U.S. Pat. No. 8,717,494; U.S. Pat. No. 8,720,783; U.S. Pat. No. 8,723,804; U.S. Pat. No. 8,723,904; U.S. Pat. No. 8,727,223; U.S. Pat. No. D702,237; U.S. Pat. No. 8,740,082; U.S. Pat. No. 8,740,085; U.S. Pat. No. 8,746,563; U.S. Pat. No. 8,750,445; U.S. Pat. No. 8,752,766; U.S. Pat. No. 8,756,059; U.S. Pat. No. 8,757,495; U.S. Pat. No. 8,760,563; U.S. Pat. No. 8,763,909; U.S. Pat. No. 8,777,108; U.S. Pat. No. 8,777,109; U.S. Pat. No. 8,779,898; U.S. Pat. No. 8,781,520; U.S. Pat. No. 8,783,573; U.S. Pat. No. 8,789,757; U.S. Pat. No. 8,789,758; U.S. Pat. No. 8,789,759; U.S. Pat. No. 8,794,520; U.S. Pat. No. 8,794,522; U.S. Pat. No. 8,794,525; U.S. Pat. No. 8,794,526; U.S. Pat. No. 8,798,367; U.S. Pat. No. 8,807,431; U.S. Pat. No. 8,807,432; U.S. Pat. No. 8,820,630; U.S. Pat. No. 8,822,848; U.S. Pat. No. 8,824,692; U.S. Pat. No. 8,824,696; U.S. Pat. No. 8,842,849; U.S. Pat. No. 8,844,822; U.S. Pat. No. 8,844,823; U.S. Pat. No. 8,849,019; U.S. Pat. No. 8,851,383; U.S. Pat. No. 8,854,633; U.S. Pat. No. 8,866,963; U.S. Pat. No. 8,868,421; U.S. Pat. No. 8,868,519; U.S. Pat. No. 8,868,802; U.S. Pat. No. 8,868,803; U.S. Pat. No. 8,870,074; U.S. Pat. No. 8,879,639; U.S. Pat. No. 8,880,426; U.S. Pat. No. 8,881,983; U.S. Pat. No. 8,881,987; U.S. Pat. No. 8,903,172; U.S. Pat. No. 8,908,995; U.S. Pat. No. 8,910,870; U.S. Pat. No. 8,910,875; U.S. Pat. No. 8,914,290; U.S. Pat. No. 8,914,788; U.S. Pat. No. 8,915,439; U.S. Pat. No. 8,915,444; U.S. Pat. No. 8,916,789; U.S. Pat. No. 8,918,250; U.S. Pat. No. 8,918,564; U.S. Pat. No. 8,925,818; U.S. Pat. No. 8,939,374; U.S. Pat. No. 8,942,480; U.S. Pat. No. 8,944,313; U.S. Pat. No. 8,944,327; U.S. Pat. No. 8,944,332; U.S. Pat. No. 8,950,678; U.S. Pat. No. 8,967,468; U.S. Pat. No. 8,971,346; U.S. Pat. No. 8,976,030; U.S. Pat. No. 8,976,368; U.S. Pat. No. 8,978,981; U.S. Pat. No. 8,978,983; U.S. Pat. No. 8,978,984; U.S. Pat. No. 8,985,456; U.S. Pat. No. 8,985,457; U.S. Pat. No. 8,985,459; U.S. Pat. No. 8,985,461; U.S. Pat. No. 8,988,578; U.S. Pat. No. 8,988,590; U.S. Pat. No. 8,991,704; U.S. Pat. No. 8,996,194; U.S. Pat. No. 8,996,384; U.S. Pat. No. 9,002,641; U.S. Pat. No. 9,007,368; U.S. Pat. No. 9,010,641; U.S. Pat. No. 9,015,513; U.S. Pat. No. 9,016,576; U.S. Pat. No. 9,022,288; U.S. Pat. No. 9,030,964; U.S. Pat. No. 9,033,240; U.S. Pat. No. 9,033,242; U.S. Pat. No. 9,036,054; U.S. Pat. No. 9,037,344; U.S. Pat. No. 9,038,911; U.S. Pat. No. 9,038,915; U.S. Pat. No. 9,047,098; U.S. Pat. No. 9,047,359; U.S. Pat. No. 9,047,420; U.S. Pat. No. 9,047,525; U.S. Pat. No. 9,047,531; U.S. Pat. No. 9,053,055; U.S. Pat. No. 9,053,378; U.S. Pat. No. 9,053,380; U.S. Pat. No. 9,058,526; U.S. Pat. No. 9,064,165; U.S. Pat. No. 9,064,167; U.S. Pat. No. 9,064,168; U.S. Pat. No. 9,064,254; U.S. Pat. No. 9,066,032; U.S. Pat. No. 9,070,032;
U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D733,112;
U.S. Design Pat. No. D734,339;
International Publication No. 2013/163789;
International Publication No. 2013/173985;
International Publication No. 2014/019130;
International Publication No. 2014/110495;
U.S. Patent Application Publication No. 2008/0185432;
U.S. Patent Application Publication No. 2009/0134221;
U.S. Patent Application Publication No. 2010/0177080;

U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0287258;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0313325;
U.S. Patent Application Publication No. 2013/0342717;
U.S. Patent Application Publication No. 2014/0001267;
U.S. Patent Application Publication No. 2014/0008439;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0042814;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0078341;
U.S. Patent Application Publication No. 2014/0078345;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0104451;
U.S. Patent Application Publication No. 2014/0106594;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0114530;
U.S. Patent Application Publication No. 2014/0124577;
U.S. Patent Application Publication No. 2014/0124579;
U.S. Patent Application Publication No. 2014/0125842;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131438;
U.S. Patent Application Publication No. 2014/0131441;
U.S. Patent Application Publication No. 2014/0131443;
U.S. Patent Application Publication No. 2014/0131444;
U.S. Patent Application Publication No. 2014/0131445;
U.S. Patent Application Publication No. 2014/0131448;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0151453;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166755;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0175172;
U.S. Patent Application Publication No. 2014/0191644;
U.S. Patent Application Publication No. 2014/0191913;
U.S. Patent Application Publication No. 2014/0197238;
U.S. Patent Application Publication No. 2014/0197239;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0217180;
U.S. Patent Application Publication No. 2014/0231500;
U.S. Patent Application Publication No. 2014/0232930;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0267609;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0278391;
U.S. Patent Application Publication No. 2014/0282210;
U.S. Patent Application Publication No. 2014/0284384;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0312121;
U.S. Patent Application Publication No. 2014/0319220;
U.S. Patent Application Publication No. 2014/0319221;
U.S. Patent Application Publication No. 2014/0326787;
U.S. Patent Application Publication No. 2014/0332590;
U.S. Patent Application Publication No. 2014/0344943;
U.S. Patent Application Publication No. 2014/0346233;
U.S. Patent Application Publication No. 2014/0351317;
U.S. Patent Application Publication No. 2014/0353373;
U.S. Patent Application Publication No. 2014/0361073;
U.S. Patent Application Publication No. 2014/0361082;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;
U.S. Patent Application Publication No. 2015/0003673;
U.S. Patent Application Publication No. 2015/0009338;
U.S. Patent Application Publication No. 2015/0009610;
U.S. Patent Application Publication No. 2015/0014416;

U.S. Patent Application Publication No. 2015/0021397;
U.S. Patent Application Publication No. 2015/0028102;
U.S. Patent Application Publication No. 2015/0028103;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0048168;
U.S. Patent Application Publication No. 2015/0049347;
U.S. Patent Application Publication No. 2015/0051992;
U.S. Patent Application Publication No. 2015/0053766;
U.S. Patent Application Publication No. 2015/0053768;
U.S. Patent Application Publication No. 2015/0053769;
U.S. Patent Application Publication No. 2015/0060544;
U.S. Patent Application Publication No. 2015/0062366;
U.S. Patent Application Publication No. 2015/0063215;
U.S. Patent Application Publication No. 2015/0063676;
U.S. Patent Application Publication No. 2015/0069130;
U.S. Patent Application Publication No. 2015/0071819;
U.S. Patent Application Publication No. 2015/0083800;
U.S. Patent Application Publication No. 2015/0086114;
U.S. Patent Application Publication No. 2015/0088522;
U.S. Patent Application Publication No. 2015/0096872;
U.S. Patent Application Publication No. 2015/0099557;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0129659;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0136854;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0144701;
U.S. Patent Application Publication No. 2015/0149946;
U.S. Patent Application Publication No. 2015/0161429;
U.S. Patent Application Publication No. 2015/0169925;
U.S. Patent Application Publication No. 2015/0169929;
U.S. Patent Application Publication No. 2015/0178523;
U.S. Patent Application Publication No. 2015/0178534;
U.S. Patent Application Publication No. 2015/0178535;
U.S. Patent Application Publication No. 2015/0178536;
U.S. Patent Application Publication No. 2015/0178537;
U.S. Patent Application Publication No. 2015/0181093;
U.S. Patent Application Publication No. 2015/0181109;

U.S. patent application Ser. No. 13/367,978 for a Laser Scanning Module Employing an Elastomeric U-Hinge Based Laser Scanning Assembly, filed Feb. 7, 2012 (Feng et al.);

U.S. patent application Ser. No. 29/458,405 for an Electronic Device, filed Jun. 19, 2013 (Fitch et al.);

U.S. patent application Ser. No. 29/459,620 for an Electronic Device Enclosure, filed Jul. 2, 2013 (London et al.);

U.S. patent application Ser. No. 29/468,118 for an Electronic Device Case, filed Sep. 26, 2013 (Oberpriller et al.);

U.S. patent application Ser. No. 14/150,393 for Indicia-reader Having Unitary Construction Scanner, filed Jan. 8, 2014 (Colavito et al.);

U.S. patent application Ser. No. 14/200,405 for Indicia Reader for Size-Limited Applications filed Mar. 7, 2014 (Feng et al.);

U.S. patent application Ser. No. 14/231,898 for Hand-Mounted Indicia-Reading Device with Finger Motion Triggering filed Apr. 1, 2014 (Van Horn et al.);

U.S. patent application Ser. No. 29/486,759 for an Imaging Terminal, filed Apr. 2, 2014 (Oberpriller et al.);

U.S. patent application Ser. No. 14/257,364 for Docking System and Method Using Near Field Communication filed Apr. 21, 2014 (Showering);

U.S. patent application Ser. No. 14/264,173 for Autofocus Lens System for Indicia Readers filed Apr. 29, 2014 (Ackley et al.);

U.S. patent application Ser. No. 14/277,337 for MULTI-PURPOSE OPTICAL READER, filed May 14, 2014 (Jovanovski et al.);

U.S. patent application Ser. No. 14/283,282 for TERMINAL HAVING ILLUMINATION AND FOCUS CONTROL filed May 21, 2014 (Liu et al.);

U.S. patent application Ser. No. 14/327,827 for a MOBILE-PHONE ADAPTER FOR ELECTRONIC TRANSACTIONS, filed Jul. 10, 2014 (Hejl);

U.S. patent application Ser. No. 14/334,934 for a SYSTEM AND METHOD FOR INDICIA VERIFICATION, filed Jul. 18, 2014 (Hejl);

U.S. patent application Ser. No. 14/339,708 for LASER SCANNING CODE SYMBOL READING SYSTEM, filed Jul. 24, 2014 (Xian et al.);

U.S. patent application Ser. No. 14/340,627 for an AXIALLY REINFORCED FLEXIBLE SCAN ELEMENT, filed Jul. 25, 2014 (Rueblinger et al.);

U.S. patent application Ser. No. 14/446,391 for MULTI-FUNCTION POINT OF SALE APPARATUS WITH OPTICAL SIGNATURE CAPTURE filed Jul. 30, 2014 (Good et al.);

U.S. patent application Ser. No. 14/452,697 for INTERACTIVE INDICIA READER, filed Aug. 6, 2014 (Todeschini);

U.S. patent application Ser. No. 14/453,019 for DIMENSIONING SYSTEM WITH GUIDED ALIGNMENT, filed Aug. 6, 2014 (Li et al.);

U.S. patent application Ser. No. 14/462,801 for MOBILE COMPUTING DEVICE WITH DATA COGNITION SOFTWARE, filed on Aug. 19, 2014 (Todeschini et al.);

U.S. patent application Ser. No. 14/483,056 for VARIABLE DEPTH OF FIELD BARCODE SCANNER filed Sep. 10, 2014 (McCloskey et al.);

U.S. patent application Ser. No. 14/513,808 for IDENTIFYING INVENTORY ITEMS IN A STORAGE FACILITY filed Oct. 14, 2014 (Singel et al.);

U.S. patent application Ser. No. 14/519,195 for HANDHELD DIMENSIONING SYSTEM WITH FEEDBACK filed Oct. 21, 2014 (Laffargue et al.);

U.S. patent application Ser. No. 14/519,179 for DIMENSIONING SYSTEM WITH MULTIPATH INTERFERENCE MITIGATION filed Oct. 21, 2014 (Thuries et al.);

U.S. patent application Ser. No. 14/519,211 for SYSTEM AND METHOD FOR DIMENSIONING filed Oct. 21, 2014 (Ackley et al.);

U.S. patent application Ser. No. 14/519,233 for HANDHELD DIMENSIONER WITH DATA-QUALITY INDICATION filed Oct. 21, 2014 (Laffargue et al.);

U.S. patent application Ser. No. 14/519,249 for HANDHELD DIMENSIONING SYSTEM WITH MEASUREMENT-CONFORMANCE FEEDBACK filed Oct. 21, 2014 (Ackley et al.);

U.S. patent application Ser. No. 14/527,191 for METHOD AND SYSTEM FOR RECOGNIZING SPEECH USING WILDCARDS IN AN EXPECTED RESPONSE filed Oct. 29, 2014 (Braho et al.);

U.S. patent application Ser. No. 14/529,563 for ADAPTABLE INTERFACE FOR A MOBILE COMPUTING DEVICE filed Oct. 31, 2014 (Schoon et al.);

U.S. patent application Ser. No. 14/529,857 for BARCODE READER WITH SECURITY FEATURES filed Oct. 31, 2014 (Todeschini et al.);

U.S. patent application Ser. No. 14/398,542 for PORTABLE ELECTRONIC DEVICES HAVING A SEPARATE LOCATION TRIGGER UNIT FOR USE IN CONTROLLING AN APPLICATION UNIT filed Nov. 3, 2014 (Bian et al.);

U.S. patent application Ser. No. 14/531,154 for DIRECTING AN INSPECTOR THROUGH AN INSPECTION filed Nov. 3, 2014 (Miller et al.);

U.S. patent application Ser. No. 14/533,319 for BARCODE SCANNING SYSTEM USING WEARABLE DEVICE WITH EMBEDDED CAMERA filed Nov. 5, 2014 (Todeschini);

U.S. patent application Ser. No. 14/535,764 for CONCATENATED EXPECTED RESPONSES FOR SPEECH RECOGNITION filed Nov. 7, 2014 (Braho et al.);

U.S. patent application Ser. No. 14/568,305 for AUTO-CONTRAST VIEWFINDER FOR AN INDICIA READER filed Dec. 12, 2014 (Todeschini);

U.S. patent application Ser. No. 14/573,022 for DYNAMIC DIAGNOSTIC INDICATOR GENERATION filed Dec. 17, 2014 (Goldsmith);

U.S. patent application Ser. No. 14/578,627 for SAFETY SYSTEM AND METHOD filed Dec. 22, 2014 (Ackley et al.);

U.S. patent application Ser. No. 14/580,262 for MEDIA GATE FOR THERMAL TRANSFER PRINTERS filed Dec. 23, 2014 (Bowles);

U.S. patent application Ser. No. 14/590,024 for SHELVING AND PACKAGE LOCATING SYSTEMS FOR DELIVERY VEHICLES filed Jan. 6, 2015 (Payne);

U.S. patent application Ser. No. 14/596,757 for SYSTEM AND METHOD FOR DETECTING BARCODE PRINTING ERRORS filed Jan. 14, 2015 (Ackley);

U.S. patent application Ser. No. 14/416,147 for OPTICAL READING APPARATUS HAVING VARIABLE SETTINGS filed Jan. 21, 2015 (Chen et al.);

U.S. patent application Ser. No. 14/614,706 for DEVICE FOR SUPPORTING AN ELECTRONIC TOOL ON A USER'S HAND filed Feb. 5, 2015 (Oberpriller et al.);

U.S. patent application Ser. No. 14/614,796 for CARGO APPORTIONMENT TECHNIQUES filed Feb. 5, 2015 (Morton et al.);

U.S. patent application Ser. No. 29/516,892 for TABLE COMPUTER filed Feb. 6, 2015 (Bidwell et al.);

U.S. patent application Ser. No. 14/619,093 for METHODS FOR TRAINING A SPEECH RECOGNITION SYSTEM filed Feb. 11, 2015 (Pecorari);

U.S. patent application Ser. No. 14/628,708 for DEVICE, SYSTEM, AND METHOD FOR DETERMINING THE STATUS OF CHECKOUT LANES filed Feb. 23, 2015 (Todeschini);

U.S. patent application Ser. No. 14/630,841 for TERMINAL INCLUDING IMAGING ASSEMBLY filed Feb. 25, 2015 (Gomez et al.);

U.S. patent application Ser. No. 14/635,346 for SYSTEM AND METHOD FOR RELIABLE STORE-AND-FORWARD DATA HANDLING BY ENCODED INFORMATION READING TERMINALS filed Mar. 2, 2015 (Sevier);

U.S. patent application Ser. No. 29/519,017 for SCANNER filed Mar. 2, 2015 (Zhou et al.);

U.S. patent application Ser. No. 14/405,278 for DESIGN PATTERN FOR SECURE STORE filed Mar. 9, 2015 (Zhu et al.);

U.S. patent application Ser. No. 14/660,970 for DECODABLE INDICIA READING TERMINAL WITH COMBINED ILLUMINATION filed Mar. 18, 2015 (Kearney et al.);

U.S. patent application Ser. No. 14/661,013 for REPROGRAMMING SYSTEM AND METHOD FOR DEVICES INCLUDING PROGRAMMING SYMBOL filed Mar. 18, 2015 (Soule et al.);

U.S. patent application Ser. No. 14/662,922 for MULTI-FUNCTION POINT OF SALE SYSTEM filed Mar. 19, 2015 (Van Horn et al.);

U.S. patent application Ser. No. 14/663,638 for VEHICLE MOUNT COMPUTER WITH CONFIGURABLE IGNITION SWITCH BEHAVIOR filed Mar. 20, 2015 (Davis et al.);

U.S. patent application Ser. No. 14/664,063 for METHOD AND APPLICATION FOR SCANNING A BARCODE WITH A SMART DEVICE WHILE CONTINUOUSLY RUNNING AND DISPLAYING AN APPLICATION ON THE SMART DEVICE DISPLAY filed Mar. 20, 2015 (Todeschini);

U.S. patent application Ser. No. 14/669,280 for TRANSFORMING COMPONENTS OF A WEB PAGE TO VOICE PROMPTS filed Mar. 26, 2015 (Funyak et al.);

U.S. patent application Ser. No. 14/674,329 for AIMER FOR BARCODE SCANNING filed Mar. 31, 2015 (Bidwell);

U.S. patent application Ser. No. 14/676,109 for INDICIA READER filed Apr. 1, 2015 (Huck);

U.S. patent application Ser. No. 14/676,327 for DEVICE MANAGEMENT PROXY FOR SECURE DEVICES filed Apr. 1, 2015 (Yeakley et al.);

U.S. patent application Ser. No. 14/676,898 for NAVIGATION SYSTEM CONFIGURED TO INTEGRATE MOTION SENSING DEVICE INPUTS filed Apr. 2, 2015 (Showering);

U.S. patent application Ser. No. 14/679,275 for DIMENSIONING SYSTEM CALIBRATION SYSTEMS AND METHODS filed Apr. 6, 2015 (Laffargue et al.);

U.S. patent application Ser. No. 29/523,098 for HANDLE FOR A TABLET COMPUTER filed Apr. 7, 2015 (Bidwell et al.);

U.S. patent application Ser. No. 14/682,615 for SYSTEM AND METHOD FOR POWER MANAGEMENT OF MOBILE DEVICES filed Apr. 9, 2015 (Murawski et al.);

U.S. patent application Ser. No. 14/686,822 for MULTIPLE PLATFORM SUPPORT SYSTEM AND METHOD filed Apr. 15, 2015 (Qu et al.);

U.S. patent application Ser. No. 14/687,289 for SYSTEM FOR COMMUNICATION VIA A PERIPHERAL HUB filed Apr. 15, 2015 (Kohtz et al.);

U.S. patent application Ser. No. 29/524,186 for SCANNER filed Apr. 17, 2015 (Zhou et al.);

U.S. patent application Ser. No. 14/695,364 for MEDICATION MANAGEMENT SYSTEM filed Apr. 24, 2015 (Sewell et al.);

U.S. patent application Ser. No. 14/695,923 for SECURE UNATTENDED NETWORK AUTHENTICATION filed Apr. 24, 2015 (Kubler et al.);

U.S. patent application Ser. No. 29/525,068 for TABLET COMPUTER WITH REMOVABLE SCANNING DEVICE filed Apr. 27, 2015 (Schulte et al.);

U.S. patent application Ser. No. 14/699,436 for SYMBOL READING SYSTEM HAVING PREDICTIVE DIAGNOSTICS filed Apr. 29, 2015 (Nahill et al.);

U.S. patent application Ser. No. 14/702,110 for SYSTEM AND METHOD FOR REGULATING BARCODE DATA INJECTION INTO A RUNNING APPLICATION ON A SMART DEVICE filed May 1, 2015 (Todeschini et al.);

U.S. patent application Ser. No. 14/702,979 for TRACKING BATTERY CONDITIONS filed May 4, 2015 (Young et al.);

U.S. patent application Ser. No. 14/704,050 for INTERMEDIATE LINEAR POSITIONING filed May 5, 2015 (Charpentier et al.);

U.S. patent application Ser. No. 14/705,012 for HANDS-FREE HUMAN MACHINE INTERFACE RESPONSIVE TO A DRIVER OF A VEHICLE filed May 6, 2015 (Fitch et al.);

U.S. patent application Ser. No. 14/705,407 for METHOD AND SYSTEM TO PROTECT SOFTWARE-BASED NETWORK-CONNECTED DEVICES FROM ADVANCED PERSISTENT THREAT filed May 6, 2015 (Hussey et al.);

U.S. patent application Ser. No. 14/707,037 for SYSTEM AND METHOD FOR DISPLAY OF INFORMATION USING A VEHICLE-MOUNT COMPUTER filed May 8, 2015 (Chamberlin);

U.S. patent application Ser. No. 14/707,123 for APPLICATION INDEPENDENT DEX/UCS INTERFACE filed May 8, 2015 (Pape);

U.S. patent application Ser. No. 14/707,492 for METHOD AND APPARATUS FOR READING OPTICAL INDICIA USING A PLURALITY OF DATA SOURCES filed May 8, 2015 (Smith et al.);

U.S. patent application Ser. No. 14/710,666 for PRE-PAID USAGE SYSTEM FOR ENCODED INFORMATION READING TERMINALS filed May 13, 2015 (Smith);

U.S. patent application Ser. No. 29/526,918 for CHARGING BASE filed May 14, 2015 (Fitch et al.);

U.S. patent application Ser. No. 14/715,672 for AUGUMENTED REALITY ENABLED HAZARD DISPLAY filed May 19, 2015 (Venkatesha et al.);

U.S. patent application Ser. No. 14/715,916 for EVALUATING IMAGE VALUES filed May 19, 2015 (Ackley);

U.S. patent application Ser. No. 14/722,608 for INTERACTIVE USER INTERFACE FOR CAPTURING A DOCUMENT IN AN IMAGE SIGNAL filed May 27, 2015 (Showering et al.);

U.S. patent application Ser. No. 29/528,165 for IN-COUNTER BARCODE SCANNER filed May 27, 2015 (Oberpriller et al.);

U.S. patent application Ser. No. 14/724,134 for ELECTRONIC DEVICE WITH WIRELESS PATH SELECTION CAPABILITY filed May 28, 2015 (Wang et al.);

U.S. patent application Ser. No. 14/724,849 for METHOD OF PROGRAMMING THE DEFAULT CABLE INTERFACE SOFTWARE IN AN INDICIA READING DEVICE filed May 29, 2015 (Barten);

U.S. patent application Ser. No. 14/724,908 for IMAGING APPARATUS HAVING IMAGING ASSEMBLY filed May 29, 2015 (Barber et al.);

U.S. patent application Ser. No. 14/725,352 for APPARATUS AND METHODS FOR MONITORING ONE OR MORE PORTABLE DATA TERMINALS (Caballero et al.);

U.S. patent application Ser. No. 29/528,590 for ELECTRONIC DEVICE filed May 29, 2015 (Fitch et al.);

U.S. patent application Ser. No. 29/528,890 for MOBILE COMPUTER HOUSING filed Jun. 2, 2015 (Fitch et al.);

U.S. patent application Ser. No. 14/728,397 for DEVICE MANAGEMENT USING VIRTUAL INTERFACES CROSS-REFERENCE TO RELATED APPLICATIONS filed Jun. 2, 2015 (Caballero);

U.S. patent application Ser. No. 14/732,870 for DATA COLLECTION MODULE AND SYSTEM filed Jun. 8, 2015 (Powilleit);

U.S. patent application Ser. No. 29/529,441 for INDICIA READING DEVICE filed Jun. 8, 2015 (Zhou et al.);

U.S. patent application Ser. No. 14/735,717 for INDICIA-READING SYSTEMS HAVING AN INTERFACE WITH A USER'S NERVOUS SYSTEM filed Jun. 10, 2015 (Todeschini);

U.S. patent application Ser. No. 14/738,038 for METHOD OF AND SYSTEM FOR DETECTING OBJECT WEIGHING INTERFERENCES filed Jun. 12, 2015 (Amundsen et al.);

U.S. patent application Ser. No. 14/740,320 for TACTILE SWITCH FOR A MOBILE ELECTRONIC DEVICE filed Jun. 16, 2015 (Bandringa);

U.S. patent application Ser. No. 14/740,373 for CALIBRATING A VOLUME DIMENSIONER filed Jun. 16, 2015 (Ackley et al.);

U.S. patent application Ser. No. 14/742,818 for INDICIA READING SYSTEM EMPLOYING DIGITAL GAIN CONTROL filed Jun. 18, 2015 (Xian et al.);

U.S. patent application Ser. No. 14/743,257 for WIRELESS MESH POINT PORTABLE DATA TERMINAL filed Jun. 18, 2015 (Wang et al.);

U.S. patent application Ser. No. 29/530,600 for CYCLONE filed Jun. 18, 2015 (Vargo et al);

U.S. patent application Ser. No. 14/744,633 for IMAGING APPARATUS COMPRISING IMAGE SENSOR ARRAY HAVING SHARED GLOBAL SHUTTER CIRCUITRY filed Jun. 19, 2015 (Wang);

U.S. patent application Ser. No. 14/744,836 for CLOUD-BASED SYSTEM FOR READING OF DECODABLE INDICIA filed Jun. 19, 2015 (Todeschini et al.);

U.S. patent application Ser. No. 14/745,006 for SELECTIVE OUTPUT OF DECODED MESSAGE DATA filed Jun. 19, 2015 (Todeschini et al.);

U.S. patent application Ser. No. 14/747,197 for OPTICAL PATTERN PROJECTOR filed Jun. 23, 2015 (Thuries et al.);

U.S. patent application Ser. No. 14/747,490 for DUAL-PROJECTOR THREE-DIMENSIONAL SCANNER filed Jun. 23, 2015 (Jovanovski et al.); and U.S. patent application Ser. No. 14/748,446 for CORDLESS INDICIA READER WITH A MULTIFUNCTION COIL FOR WIRELESS CHARGING AND EAS DEACTIVATION, filed Jun. 24, 2015 (Xie et al.).

Other Embodiments and Aspects

The foregoing detailed description and accompanying figures set forth typical embodiments of the devices, systems, and methods presently disclosed. The present disclosure is not limited to such exemplary embodiments. It will be apparent that numerous other devices, systems, and methods may be provided in accordance with the present disclosure. The present disclosure may utilize any variety of aspects, features, or steps, or combinations thereof which may be within the contemplation of those skilled in the art.

Various embodiments have been set forth via the use of block diagrams, flowcharts, and/or examples. Insofar as such block diagrams, flowcharts, and/or examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects and/or features of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of ordinary skill in the art in light of the present disclosure.

In addition, those skilled in the art will appreciate that some mechanisms of the subject matter described herein are capable of being distributed as a program product in a variety of forms, and that an illustrative embodiment of the subject matter described herein applies equally regardless of the signal bearing media used to carry out the distribution. Examples of a signal bearing media include, but are not limited to, the following: recordable type media such as volatile and non-volatile memory devices, floppy and other removable disks, hard disk drives, SSD drives, flash drives, optical discs (e.g., CD ROMs, DVDs, etc.), and computer memory; and transmission type media such as digital and analog communication links using TDM or IP based communication links (e.g., packet links).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control elements (e.g., feedback for sensing temperature; control heaters for adjusting temperature). A typical data processing system may be implemented utilizing any suitable commercially available components, such as those typically found in data computing/communication and/or network computing/communication systems.

The foregoing described aspects depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a functionality can be seen as "associated with" each other such that the desired functionality is achieved, irrespective of architectures or intermedial components. Likewise, any two components so associated can also be viewed as being "operably connected", or "operably coupled", to each other to achieve the desired functionality. Specific examples of operably couplable include but are not limited to physically mateable and/or physically interacting components and/or wirelessly interactable and/or wirelessly interacting components and/or logically interacting and/or logically interactable components.

The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

While various aspects, features, and embodiments have been disclosed herein, other aspects, features, and embodiments will be apparent to those skilled in the art. The various aspects, features, and embodiments disclosed herein are for purposes of illustration and are not intended to be limiting. It is intended that the scope of the present invention be defined by the following claims and their equivalents:

The invention claimed is:

1. A printing system comprising:

a print head in association with a platen roller for printing;

a media configured to follow a media supply path which passes between said platen roller and said print head;

a ribbon, comprising a substrate layer and a thermal transfer layer comprising ink, configured to follow a ribbon path which passes between said print head and said platen roller;

a ribbon sensor, positioned so as to face a surface of the ribbon and configured to detect a reflectance value from a ribbon to be utilized by the printing system;

wherein the printing system is configured to ascertain that the substrate layer faces the ribbon sensor when the reflectance value corresponds to a substantially specular reflectance, and/or to ascertain that the thermal transfer layer faces the ribbon sensor when the reflectance value corresponds to a substantially diffuse reflectance.

2. The printing system of claim 1, wherein the ribbon sensor is positioned to face the substrate layer when the ribbon is properly oriented.

3. The printing system of claim 1, wherein the ribbon sensor is positioned to face the thermal transfer layer when the ribbon is properly oriented.

4. The printing system of claim 1, wherein the ribbon sensor is triggered upon closing a door or panel, wherein said door panel is to access and replenish a ribbon of the printing system.

5. The printing system of claim 1, wherein the said ascertaining is based on the reflectance from the substrate layer differing from the reflectance the thermal transfer layer by 10% or more.

6. The printing system of claim 1, wherein the printing system is configured to ascertain, based on reflectance value detected by the ribbon sensor, whether or not the printing ribbon is properly oriented with the substrate layer facing the print head and the thermal transfer layer facing the media.

7. The printing system of claim 6, wherein the printing system is configured to trigger a response when the ribbon is not properly oriented, the response comprising one or more of: an audible alert, a visual alert, a stop print command, re-routing one or more print jobs to a different printing system, and/or requesting a standby printing system.

8. The printing system of claim 1, wherein the printing system is configured such that either the ribbon sensor faces the substrate layer of a properly oriented printing ribbon or such that the ribbon sensor faces the thermal transfer layer of a properly oriented printing ribbon.

9. The printing system of claim 1, wherein the printing system is configured to:

ascertain that the thermal transfer layer of the printing ribbon faces the ribbon sensor when the ribbon sensor returns a reflectance below a threshold; and/or ascertain that the substrate layer of the printing ribbon faces the ribbon sensor when the ribbon sensor returns a reflectance above a threshold.

10. A device comprising:

a print head in association with a platen roller for printing;

a media configured to follow a media supply path between the said platen roller and the print head;

a ribbon comprising a first surface comprising a substantially specular substrate having a first reflectivity and a second surface comprising a substantially diffuse functional layer having a second reflectivity, the first reflectance being greater than the second reflectivity;

a ribbon supply spool and a ribbon take-up spool configured to supply the said ribbon along a ribbon supply path leading from the ribbon supply spool past the print head and to the ribbon take-up spool; and a ribbon sensor, positioned so as to face a surface of the printing ribbon and configured to detect a reflectance value from a printing ribbon to be utilized by the device;

wherein the device is configured to ascertain that the first surface faces the ribbon sensor when the reflectance value detected corresponds to a substantially specular reflectance as expected from the first surface, and/or the second surface faces the ribbon sensor when the reflectance value detected corresponds to a substantially diffuse reflectance as expected from the second surface.

11. The device of claim 10, wherein the ribbon sensor is positioned to face the first surface when the ribbon is properly oriented.

12. The device of claim 10, wherein the device is configured to ascertain, based on reflectance value detected by the ribbon sensor, whether or not the ribbon is properly oriented with the first surface facing the print head and the second surface facing the media.

13. The device of claim 12, wherein the device is configured to trigger a response when ribbon is not oriented properly, the response comprising one or more of: an audible alert, a visual alert, a stop print command, re-routing one or more print jobs to a different device, and/or requesting a standby device.

14. The device of claim 10, wherein the device is configured:

ascertain that the second surface of the ribbon faces the ribbon sensor when the ribbon sensor returns a reflectance below a threshold; and/or ascertain that the first surface of the ribbon faces the ribbon sensor when the ribbon sensor returns a reflectance above a threshold.

15. A method comprising:

providing a printer comprising a print head configured to transfer an ink from a printing ribbon to a media, the printer comprising a ribbon sensor configured to detect a reflectance value from a printing ribbon to be utilized by the printer;

detecting with the ribbon sensor, a reflectance value from a printing ribbon having been at least partially installed in the printer, wherein the printing ribbon comprises a substrate and a thermal transfer layer comprising the ink;

ascertaining that the substrate faces the ribbon sensor when the reflectance value corresponds to a substantially specular reflectance, and/or ascertaining that the thermal transfer layer faces the ribbon sensor when the reflectance value corresponds to a substantially diffuse reflectance;

triggering a response upon having ascertained, based at least in part on the reflectance value detected with the ribbon sensor, that the at least partially installed printing ribbon is not properly oriented.

16. The method of claim 15, comprising ascertaining, based at least in part on the reflectance value detected with the ribbon sensor, whether or not the at least partially installed printing ribbon is properly oriented such that when having commenced printing, the substrate will face the print head and the thermal transfer layer will face the media.

17. The method of claim 15, wherein the response comprises of one or more of: an audible alert, a visual alert, a stop print command, re-routing one or more print jobs to a different printer, and/or requesting a standby printer.

18. The method of claim 15, wherein the ribbon sensor faces the substrate when the printing ribbon is properly oriented, and wherein the method further comprises:

providing an indication that the printing ribbon is improperly oriented when having ascertained that the thermal transfer layer faces the ribbon sensor; and/or providing an indication that the printing ribbon is properly oriented when having ascertained that the substrate faces the ribbon sensor.

19. The method of claim 15, wherein said ascertaining is based at least in part on the reflectance value corresponding to a substantially specular reflectance differing from the reflectance value corresponding to a substantially diffuse reflectance by 10% or more.

20. The method of claim 15, comprising:

ascertaining that the thermal transfer layer of the printing ribbon faces the ribbon sensor when the ribbon sensor returns a reflectance below a threshold; and/or ascertaining that the substrate of the printing ribbon faces the ribbon sensor when the ribbon sensor returns a reflectance above a threshold.

* * * * *